US010813426B2

(12) United States Patent
Wu

(10) Patent No.: US 10,813,426 B2
(45) Date of Patent: Oct. 27, 2020

(54) MIDDLE ROD STRUCTURE OF AUTOMATIC UMBRELLA, UMBRELLA FRAME, AND AUTOMATIC UMBRELLA

(71) Applicant: Xiamen New Glory Umbrella Co., Ltd, Xiamen (CN)

(72) Inventor: Zhaozhan Wu, Xiamen (CN)

( * ) Notice: Subject to any disclaimer, the term of this patent is extended or adjusted under 35 U.S.C. 154(b) by 94 days.

(21) Appl. No.: 16/221,858

(22) Filed: Dec. 17, 2018

(65) Prior Publication Data

US 2020/0054105 A1 Feb. 20, 2020

(30) Foreign Application Priority Data

Aug. 20, 2018 (CN) ..... 2018 2 1340094 U

(51) Int. Cl.

| | |
|---|---|
| ***A45B 25/14*** | (2006.01) |
| ***A45B 25/16*** | (2006.01) |
| ***A45B 25/02*** | (2006.01) |
| ***A45B 19/00*** | (2006.01) |
| ***A45B 25/00*** | (2006.01) |

(52) U.S. Cl.

CPC ..... *A45B 25/143* (2013.01); *A45B 25/006* (2013.01); *A45B 25/02* (2013.01); *A45B 25/16* (2013.01); *A45B 2019/008* (2013.01)

(58) Field of Classification Search

CPC ..... A45B 26/006; A45B 25/14; A45B 25/16; A45B 19/10; A45B 2019/008

See application file for complete search history.

(56) References Cited

U.S. PATENT DOCUMENTS

| | | | | |
|---|---|---|---|---|
| 4,941,494 | A * | 7/1990 | Wu | A45B 25/143 135/25.3 |
| 5,740,823 | A * | 4/1998 | Lin | A45B 25/16 135/22 |
| 5,791,359 | A * | 8/1998 | Lin | A45B 25/143 135/22 |
| 6,145,522 | A * | 11/2000 | Ko | A45B 25/143 135/24 |
| 7,735,498 | B2 * | 6/2010 | You | A45B 25/143 135/24 |
| 9,131,755 | B1 * | 9/2015 | You | A45B 19/04 |
| 9,468,274 | B2 * | 10/2016 | You | A45B 19/04 |
| 9,486,044 | B1 * | 11/2016 | Dai | A45B 25/22 |
| 10,244,836 | B2 * | 4/2019 | Liu | A45B 19/10 |
| 2018/0295955 | A1 * | 10/2018 | Dai | A45B 25/02 |
| 2019/0069654 | A1 * | 3/2019 | Chen | A45B 25/22 |
| 2020/0138154 | A1 * | 5/2020 | Li | A45B 19/10 |

* cited by examiner

*Primary Examiner* — David R Dunn
*Assistant Examiner* — Danielle Jackson
(74) *Attorney, Agent, or Firm* — The Law Office of Austin Bonderer, PC; Austin Bonderer

(57) ABSTRACT

Provided is an automatic umbrella. The middle rod structure comprises an outer sleeve; a movable sleeve; a first elastic element; a locating element; an adjustment element; and a long rod comprising a long rod upper end and a long rod lower end; wherein the long rod upper end is abutted against the adjustment element, and the long rod lower end is located inside the movable sleeve for limiting the first elastic element from moving along a direction perpendicular to the longitudinal direction.

9 Claims, 21 Drawing Sheets

A−A

MIDDLE ROD STRUCTURE OF AUTOMATIC UMBRELLA, UMBRELLA FRAME, AND AUTOMATIC UMBRELLA

CROSS-REFERENCE TO RELATED APPLICATIONS

The present application claims the benefit of Chinese Patent Application. No. 201821340094.7, filed on Aug. 20, 2018. The above is hereby incorporated by reference.

TECHNICAL FIELD

The present disclosure belongs to the technical field of umbrellas, and relates to a middle rod structure of an automatic umbrella, an umbrella frame, and an automatic umbrella.

BACKGROUND ART

An umbrella is a necessary item in the daily life of people and is configured to shield sunlight or protect from wind and rain. For umbrellas on the market at present, since a piece of umbrella cloth is folded in a manner of being from top to bottom. When a user wants to enter a room or a vehicle, a folding direction of the umbrella cloth is toward the user. Hence, the user must preserve enough space to fold the umbrella cloth, and the user is inevitably exposed to the rain during the folding process. Provided here is an automatic unfolding and folding umbrella at present. A middle rod in the middle of the umbrella is provided with an elastic element. Through compression and restoration of the elastic element, the automatic folding and unfolding of the umbrella is implemented. However, the elastic element arranged in the long middle rod of an umbrella is prone to be deformed under compression after long time use. Thus, the outer sleeve of the middle rod of the umbrella is often burst by the deformation of the elastic element.

SUMMARY OF THE DISCLOSURE

The present disclosure is intended to solve the technical problem that tube burst may easily happen to a middle rod structure of an existing automatic unfolding and folding umbrella due to deformation of a spring.

In order to solve the above technical problem, the present disclosure provides a middle rod structure of an automatic umbrella. By arranging an adjustment element to adjust a length of an elastic element, the problem that the elastic element bursts an outer sleeve is solved.

To this end, a middle rod structure of an automatic umbrella is provided. The middle rod structure comprises an outer sleeve; a movable sleeve, comprising a movable sleeve upper end located inside the outer sleeve and capable of being close to or away from an outer sleeve upper end of the outer sleeve when being stressed; a first elastic element, held in the outer sleeve and capable of applying a pressure along, a longitudinal direction, to the movable sleeve abutted against a first elastic element lower end of the first elastic element when being compressed; and a locating element, located inside the outer sleeve and configured to fix a first elastic element upper end of the first elastic element. An adjustment element, configured to increase or decrease the length of the first elastic element, is arranged between the first elastic element and the locating element. The long rod is located inside the first elastic element along a longitudinal direction. The long rod comprises a long rod upper end abutted against the adjustment element, and a long rod lower end located inside the movable sleeve. The long rod it is used to limit the movement direction of the first elastic element, so that transversal movement of the first elastic element can be avoided.

In some embodiments, the adjustment element comprises an adjustment sleeve, comprising an outer edge extending longitudinally and connected with the outer sleeve; and an adjustment rod, comprising an adjustment rod upper end located inside the adjustment sleeve and capable of being moved up and down and rotated peripherally relative to the adjustment sleeve. A first clamping groove is formed on a circumference of the adjustment sleeve along the longitudinal direction. A plurality of second limiting slots is formed beside the first limiting slot and extended along the periphery of the adjustment sleeve. The plurality of second limiting slots is spaced from each other and in communication with the first limiting slot. A first clamping block protrudes from an outer circumference of the adjustment rod. The first clamping block is secured to any one of the second limiting slots by sliding along the first limiting slot and rotating relative to the adjustment sleeve.

In some embodiments, a through groove is provided on the outer sleeve in a position corresponding to the first limiting slot and the second limiting slots, so that the first limiting slot and the second limiting slots can be visible through the through groove.

In some embodiments, the adjustment element comprises a second elastic element and a limiting rod. The second elastic element comprises a second elastic element upper end abutted against the locating element and a second elastic element lower end abutted against a first supporting block. The first supporting block comprises a first support block lower end abutted against the first elastic element. The limiting rod comprises a limiting rod upper end firmly connected to the locating element. The first supporting block is capable of moving along the longitudinal direction under pressure from the first elastic element or the second elastic element.

In some embodiments, a second clamping block protrudes from a peripheral surface of the first supporting block. The outer sleeve, along the longitudinal direction, is provided with a third limiting slot which limits the directional movement of the second clamping block.

The present disclosure further provides an automatic umbrella frame, which comprises the middle frame mentioned above; an upper nest, firmly connected with an outer sleeve upper end; a lower nest, capable of being movably located over the periphery of the outer sleeve along a longitudinal direction relative to the outer sleeve; an umbrella supporting skeleton, connected to the upper nest and the lower nest and performing umbrella opening or closing operations when the lower nest is moved upwards or downwards along the longitudinal direction; a first pulley component, comprising a first pulley component lower end abutted against the locating element, and a first pulley component upper end located inside the upper nest; a lower pulley assembly, located inside the movable sleeve and abutted against a long rod lower end of the long rod; a drive mechanism, connected to a lower portion of the movable sleeve; and a line, comprising a pulley-connecting end attached to the lower pulley assembly, and a nest-connecting end attached to the lower nest. The movable sleeve or the outer sleeve is capable of detaching from the first limiting element and moving along the longitudinal direction under pressure from the first elastic element when a button arranged on the drive mechanism is pressed. The lower pulley assembly is secured to a fourth limiting slot when the first elastic element is restored to a compressed state. The fourth limiting slot is formed on a tighten-up set. The lower pulley is capable of detaching from the fourth limiting slot when the button arranged on the drive mechanism is pressed.

The lower pulley assembly comprises the tighten-up set, located in the movable sleeve; a third pulley component, located in the movable sleeve and capable of being moved along the longitudinal direction relative to the tighten-up set and connected with the pulley-connecting end of the line; and a second pulley component, disposed on an upper side of the third pulley component, and abutted against the long rod lower end of the long rod. The movable robe is threaded through the second pulley component.

In some embodiments, the umbrella supporting skeleton comprises multiple first umbrella sub-ribs, comprising a first umbrella sub-rib fixed end hinged to the upper nest; traction elements, respectively hinged to each of a first umbrella sub-rib free end of the first umbrella sub-ribs and comprising a through hole in the middle; reverse-folding umbrella ribs, respectively hinged with a first hinge element disposed at of each of the first umbrella sub-ribs; second umbrella sub-ribs, comprising a second umbrella sub-rib fixed end attached to the lower nest, and a second umbrella sub-rib free end attached to the reverse-folding umbrella rib free end; and supporting ribs, comprising a supporting rib fixed end attached to the lower nest, and a supporting rib free end attached to the first umbrella sub-rib.

In some embodiments, the drive mechanism comprises a housing, a holding groove capable of holding and limiting the first limiting element from moving along a direction perpendicular to the longitudinal direction, and a button disposed on the housing, capable of being pressed from outside and abutted against a first limiting element active end of the first limiting element; and a first limiting element passive end of the first limiting element, along a movement direction, is symmetrically provided with a first protrusion portion capable of being secured to a fifth limiting slot formed on the movable sleeve, and a second protrusion portion of which elastic elements respectively abutted against the first limiting element and the housing are sleeved at the periphery.

The present disclosure further provides an automatic umbrella, which comprises the automatic umbrella frame mentioned above; a piece of outer umbrella cloth, covering and secured to upper sides of first umbrella sub-ribs and reverse-folding umbrella ribs; and a piece of inner umbrella cloth covering and secured to lower sides of second umbrella sub-ribs; wherein the outer umbrella cloth in an umbrella opening state completely covers the inner umbrella cloth.

By adopting the above technical solutions, the present disclosure may achieve the following technical effects.

1. By increasing the adjustment element, the length of the first elastic element in a same long middle rod is reduced; and thus, with the same compression amount, the deformation of the first elastic element along the direction perpendicular to the longitudinal direction is reduced and the problem of the sleeve burst is solved.

2. By designing the adjustment element to include the adjustment rod and the adjustment sleeve that can be moved to each other up and down, the middle rod structure can be used in umbrellas comprising different lengths of the middle rod and different sizes.

3. By designing the adjustment element to include the second elastic element for receiving a compression force from the first elastic element, a pressure stressed on the first elastic element is reduced and thus the deformation of the first elastic element is reduced.

REFERENCES IN THE FIGURES

Figure 1:
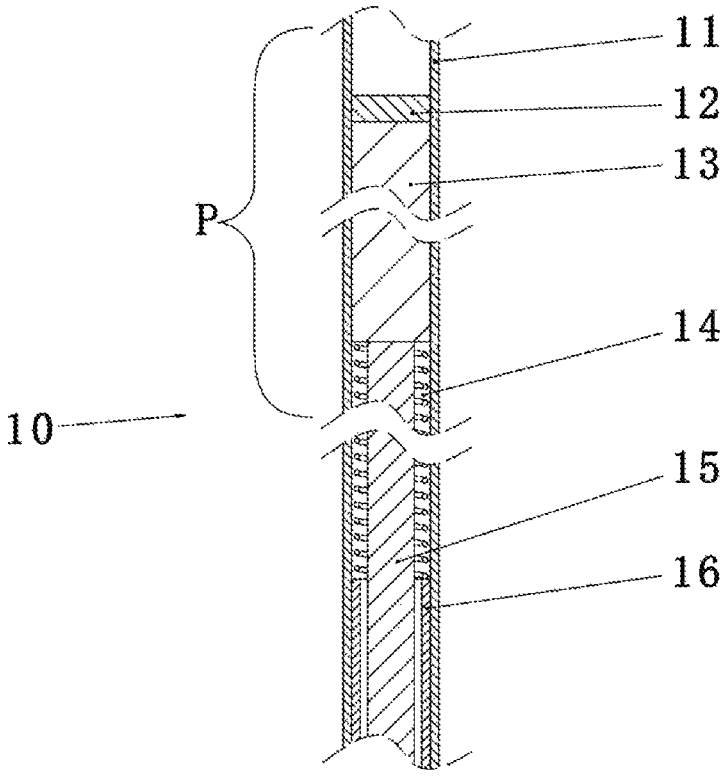
FIG. 1 is a structural schematic diagram of a middle rod in a first embodiment of the present disclosure.

10—middle rod;
11—outer sleeve;
111—third limiting slot;
112—second opening;
113—third opening;
114—eighth limiting slot;
115—ninth limiting slot;
116—tenth limiting slot;
117—reaming portion;
118—third protrusion portion;
119—sunken portion;
2—locating element;
13—adjustment element (first embodiment);
14—first elastic element;
15—long rod;
16—movable sleeve;
161—first opening;
162—sixth limiting slot;
163—seventh limiting slot;
164—chute;
17—adjustment element (second embodiment);
171—adjustment sleeve;

172—first limiting slot;
173—second limiting slot;
174—adjustment rod;
174A—first clamping block fixation hole;
175—first clamping block;
18—adjustment element (third embodiment);
181—second elastic element;
182—limiting rod;
183A—second liming block;
183A—second clamping block;
184—second reinforcing sleeve;
19—upper nest;
20—lower nest;
21—first pulley component;
211—first pulley component sleeve;
211-A—fifth opening;
211B—sixth opening;
212—first pulley;
213—second pulley;
22—lower pulley assembly;
23—drive mechanism;
231—through hole;
24—line;
25—first umbrella sub-rib;
26—reverse-folding umbrella rib;
27—supporting rib;
28—first hinge point;
29—second hinge point;
30—second umbrella sub-rib;
31—third hinge point;
32—fourth hinge point;
33—traction element;
34—tighten-up set;
341—fourth opening;
342—fourth limiting slot;
343—second limiting element;
344—fifth limiting slot;
35—second pulley component;
351—second pulley component sleeve;
352—third pulley;
353—fourth pulley;
354—third limiting block;
36—third pulley component;
361—fixed column;
362—sixth pulley;
363—third pulley component sleeve;
364—third clamping block;
37—third elastic element;
38—first limiting element;
381—first protrusion portion;
382—second protrusion portion;
383—first pressure portion;
384—second pressure portion;
39—button;
391—first pressing portion;
392—second pressing portion;
393—third pressing portion;
40—housing;
41—nest hole;
42—eleventh limiting slot;
43—twelfth limiting slot;
44—second supporting block;
45—first reinforcing sleeve;
5—deformation portion.

DETAILED DESCRIPTION OF THE DISCLOSURE

In order to make objectives, technical solutions, and advantages of embodiments of the present disclosure clearer, the technical solutions in the embodiments of the present disclosure are described clearly and completely in the following with reference to accompanying drawings in the embodiments of the present disclosure. Apparently, the described embodiments are only part rather than all of the embodiments of the present disclosure. All other embodiments obtained by persons of ordinary skill in the art based on the embodiments of the present disclosure without creative efforts shall fall within the protection scope of the present disclosure. Therefore, the detailed description on the embodiments of the present disclosure is not intended to limit the protection scope of the present disclosure, and is merely selected embodiments of the present disclosure.

In the description of the present disclosure, it is to be noted that, a direction or a positional relationship indicated by terms "center", "longitudinal", "transverse", "length", "width", "upper", "lower", "left", "right", "vertical", "horizontal", "top", "bottom", "inner", "outer", and the like is based on that shown in the accompanying drawings, is merely to describe the present disclosure and simplify the description and does not imply or suggest that the indicated device or component must have a special direction or is constructed and operated in a special direction, and thus cannot be understood as a limit of the present disclosure.

In this present disclosure, unless explicitly specified and defined otherwise, a structure in which a first feature is "above" or "below" a second feature may include an embodiment in which the first feature is in direct contact with the second feature, and may also include an embodiment in which the first feature and the second feature are not in direct contact with each other, but are contacted via an additional feature formed therebetween. Moreover, a structure in which the first feature is "above," "on," "on top of," and "over" the second feature may include that the first feature is right or obliquely "above," "on," "over," or "on top of" the second feature, or merely means that the first feature is at a height higher than that of the second feature. A structure in which the first feature is "below", "under," and "on bottom of" the second feature may include an embodiment in which the first feature is right or obliquely "below," "under," or "on bottom of" the second feature, or merely means that the first feature is at a height lower than that of the second feature.

Figure 2:
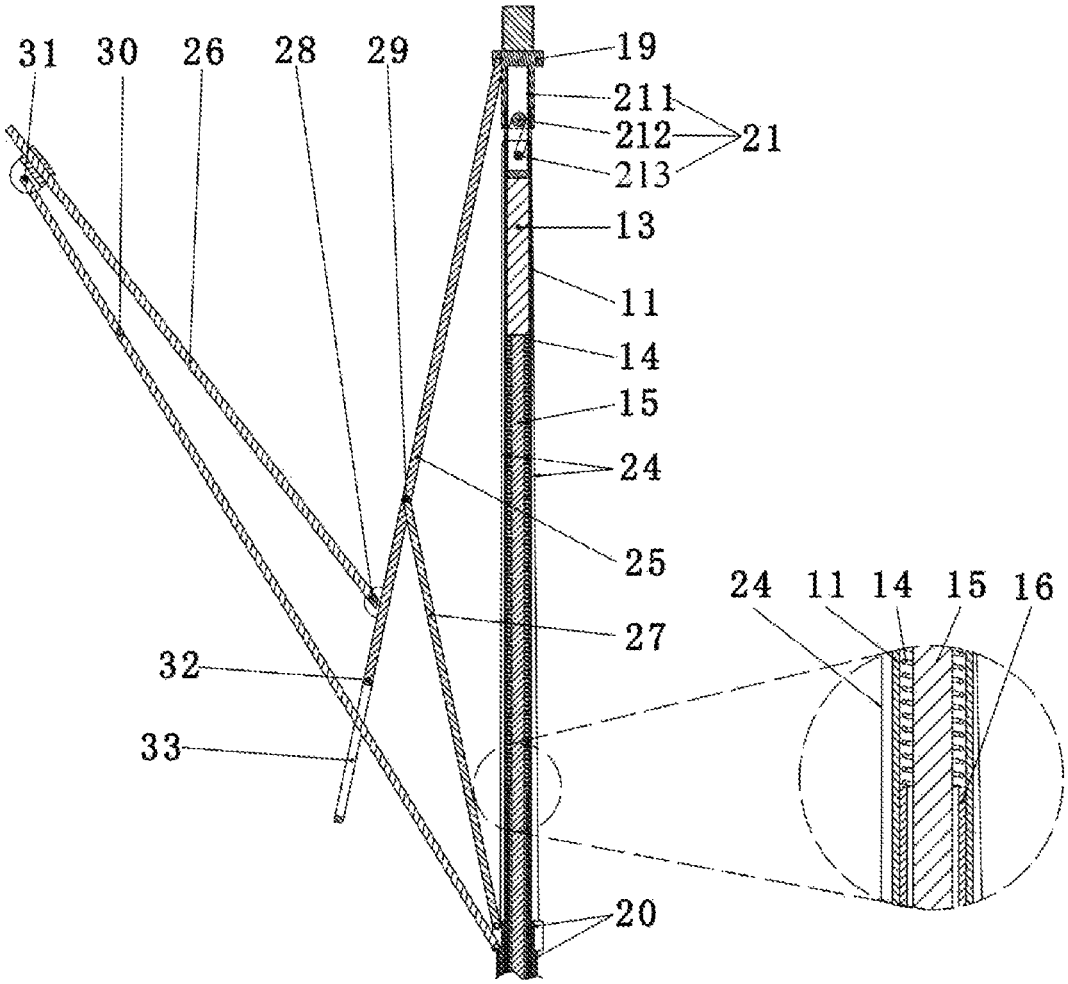
FIG. 2 and FIG. 3 are a structural schematic diagram of an umbrella frame in a first embodiment of the present disclosure.
Figure 3:
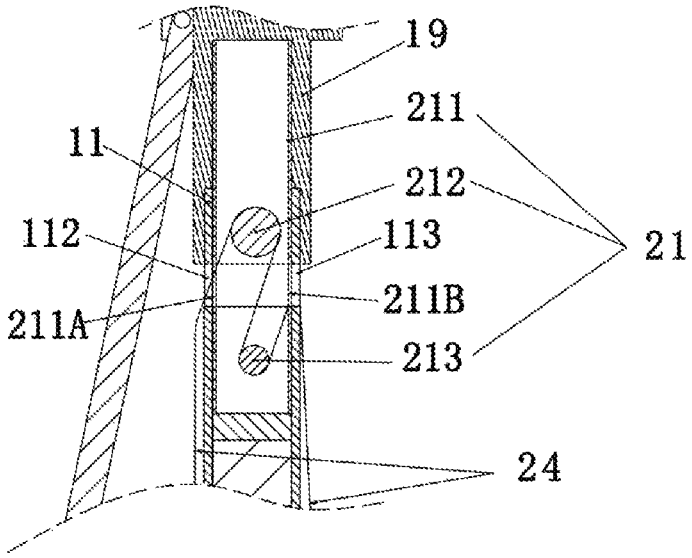

Please refer to FIG. 1, FIG. 2 and FIG. 3, as showing an embodiment of the present disclosure provides a middle rod 10 of an automatic umbrella. The middle rod 10 comprises an outer sleeve 11, a movable sleeve 16, a first elastic element 14, and a locating element 12. The outer sleeve 11 extends along a longitudinal direction. The movable sleeve 16 comprises a movable sleeve upper end located inside the outer sleeve 11 and capable of being close to or far away from an outer sleeve upper end of the outer sleeve 11 along an axial direction of the outer sleeve 11 when being stressed. The first elastic element 14 is held in the outer sleeve 11 and is capable of applying a pressure along the axial direction of the outer sleeve 11 to the movable sleeve 16 that is abutted against a first elastic element lower end of the first elastic element when being compressed. The locating element 12 is located inside the outer sleeve 11 and configured to fix a first elastic element upper end of the first elastic element 14 directly or indirectly. As shown in those figures, the locating element 12 is fixed on a top of the outer sleeve 11. The locating element 12 is close to an opening at the outer sleeve upper end of the outer sleeve 11. In some embodiments, an adjustment element 13 is arranged between the first elastic element 14 and the locating element 12.

Wherein, an adjustment element lower end of the adjustment element is abutted against the first elastic element 14 and an adjustment element upper end of the adjustment element is abutted against the locating element 12. In some embodiments, the adjustment element 13 may be a rigid and hard straight pipe, which may be solid or hollow. For example, in an embodiment shown in FIG. 9, the adjustment element 13 is a straight hollow pipe. By introducing the adjustment element 13, a length of the first elastic element 14 required in the middle rod structure can be reduced and the deformation possibility of the first elastic element 14 when being compressed is reduced. The first elastic element 14 is preferable to be hollow, for example, a spring. As shown in FIG. 1, a long rod 15 may be located inside the hollow first elastic element 14 along the axial direction of the outer sleeve 11. Wherein, a long rod upper end of the long rod 15 is abutted against the adjustment element 13 and is connected to an adjustment element lower end of the adjustment element 13. A long rod lower end of the long rod 15 extends into the movable sleeve 16, so that the movable sleeve 16 can be moved relative to the long rod 15. It may be understood that, the long rod 15 may limit the directional movement of the first elastic element 14, and thus a transversal displacement due to the deformation when the first elastic element 14 is stressed can be prevented.

Referring to FIG. 1, in at least one embodiment, the movable sleeve upper end of the movable sleeve 16 is located inside a cavity of the outer sleeve 11. As shown in FIG. 1, the movable sleeve upper end is inserted into the cavity of the outer sleeve 11 and is movable within the cavity. It may be understood that, when the movable sleeve 16 is moved downwards to a lowest point under an elastic force of the first elastic element 14, the movable sleeve upper end of the movable sleeve 16 is still located in the cavity at the outer sleeve lower end of the outer sleeve 11 and will not slip out of the cavity. Therefore, a limiting structure may be respectively arranged on the movable sleeve 16 and the outer sleeve 11. For example, a strip-shaped groove along the axial direction may be formed on an outer wall of the movable sleeve 16. A limiting convex point protrudes radially from the inner wall of the lower end of the outer sleeve 11 and is capable of matching with the strip groove. With the design of the limiting convex point and the strip-shaped groove, the movable sleeve 16 is allowed to move along the longitudinal direction. The long rod upper end of the long rod 15 is disposed in the outer sleeve 11 and extends along the longitudinal direction to pass through a center of the first elastic element 14. The long rod is configured to limit the first elastic element 14 from traversal deformation under compression. For an automatic unfolding and folding umbrella in the prior art, the elastic element is prone to be deformed and have traversal deformation under compression after extended use. Sometimes, the traversal deformation of the elastic element could be very dangerous as it ruptures the outer sleeve. It has been found by the inventor of the instant application that the longer the elastic element is, the greater the deformation. The great deformation is the cause of the blowout of the outer sleeve 11. Hence, in some embodiments, the adjustment element 13 is added at the first elastic element upper end of the first elastic element 14. After the adjustment element 13 being added, the length of the first elastic element 14 in a same middle rod will be reduced. As a result, under the same compression amount, the transversal deformation of the first elastic element 14 being compressed will be reduced as compared to the prior art, and thus the problem of sleeve blowout due to the transversal deformation can be solved. It is understood that the length of the adjustment element 13 in the present disclosure may be changed according to different requirements on the length of the first elastic element 14.

Referring to FIG. 2, some embodiments further provide a fully-automatic umbrella frame. The fully-automatic umbrella frame comprises a middle rod 10, an upper nest 19, a lower nest 20, an umbrella supporting skeleton, a first pulley component 21, a lower pulley assembly 22, a drive mechanism 23, and a line 24. The upper nest 19 is firmly connected with an outer sleeve upper end of an outer sleeve 11. The lower nest 20 is located over the outer sleeve 11 and is movable along a longitudinal direction relative to the outer sleeve 11. The umbrella supporting skeleton is connected to the upper nest 19 and the lower nest 20. The umbrella supporting skeleton is used to perform opening or closing operations of the umbrella when the lower nest 20 is moved upwards or downwards along the longitudinal direction. The first pulley component 21 comprises a first pulley component lower end abutted against the locating element 12 and a first pulley component upper end extending into the upper nest 19. The lower pulley assembly 22 is firmly located inside the movable sleeve 16 and abutted against a long rod lower end of the long rod 15. The drive mechanism 23 is firmly located inside a lower portion of the movable sleeve 16. Two ends of the line 24 are respectively connected to the lower pulley assembly 22 and the lower nest 20. The line 24 is threaded through the first pulley component 21. When the umbrella is opened, the drive mechanism 23 controls the movable sleeve 16 to move downwards along the longitudinal direction, and thus the lower pulley assembly 22 is driven to move downwards. It could be understood that, a pulley-connecting end of the line 24 which firmly connected with the lower pulley assembly 22 will be moved downwards together when the lower pulley assembly 22 is driven downwards. The nest-connecting end of the line 24 is threaded through the first pulley component 21 to pull the lower nest 20 upwards along the longitudinal direction until the line 24 is in a tensed state. It could be understood that, the lower nest 20, moved upwards along the longitudinal direction, can drive the umbrella supporting skeleton to perform opening operation of the umbrella.

Referring to FIG. 2 and FIG. 3, more specifically, the umbrella supporting skeleton comprises a plurality of first umbrella sub-ribs 25, a plurality of traction elements 33, a plurality of reverse-folding umbrella ribs 26, a plurality of second umbrella sub-ribs 30, and a plurality of supporting ribs 27. The plurality of traction elements 33 each comprises a through hole in the middle. The plurality of reverse-folding umbrella ribs 26 each is provided with a sliding block. Wherein, a first umbrella sub-rib fixed end of the first umbrella sub-rib 25 is hinged to the upper nest 19, and a first umbrella sub-rib free end is hinged with the traction elements 33. A reverse-folding umbrella rib fixed end of the reverse-folding umbrella rib 26 is hinged with a first hinge point on the first umbrella sub-rib 25 and a reverse-folding umbrella rib free end of the reverse-folding umbrella rib 26 is hinged with a second umbrella sub-rib free end of the second umbrella sub-rib 30 via the sliding block (not labeled). In some embodiments, as shown in FIG. 2, the sliding block is arranged on the second umbrella sub-rib free end and movably connected to the reverse-folding umbrella rib 26. A second umbrella sub-rib fixed end of the second umbrella sub-rib 30 extends to pass through the through hole on the traction element 33 and is hinged to the lower nest 20. It is understood that the second umbrella sub-rib 30 hinged to the lower nest 20 can be rotated around the lower nest 20 on a longitudinal plane, and the through hole on the traction element 33 allows the second umbrella sub-rib 30 to drive the traction element 33, when the second umbrella sub-rib 30 is rotated around the lower nest 20 on the longitudinal plane. Two ends of the supporting rib 27 are respectively hinged to the first umbrella sub-rib 25 and the lower nest 20.

As shown in FIG. 2, each of the first umbrella sub-ribs 25 further comprises a first hinge point 28, a second hinge point 29, and a fourth hinge point 32. Wherein, the first hinge point 28 is located between the second hinge point 29 and the fourth hinge point 32, and the fourth hinge point 32 is located at the first umbrella sub-rib free end of the first umbrella sub-rib 25. As shown in FIG. 2, the first hinge point 28 is configured to hinge together with the reverse-folding umbrella rib 26. The second hinge point 29 is configured to hinge with a supporting rib free end. The fourth hinge point 32 is configured to hinge with a traction element fixed end of the traction element 33.

Figure 4:
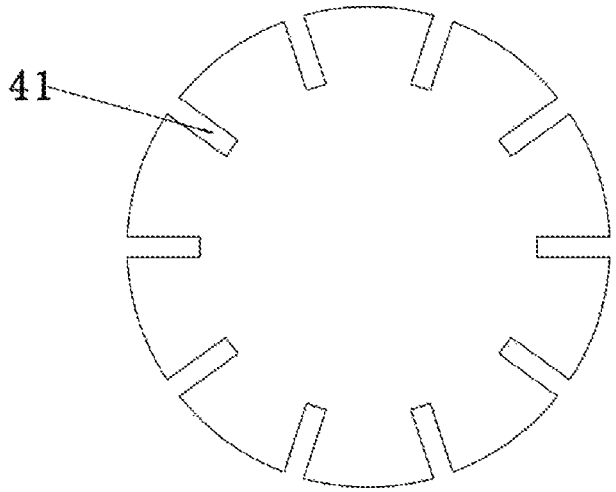
FIG. 4 is a structural schematic diagram of a nest hole of the present disclosure.

In some embodiments, referring to FIG. 4, the upper nest 19 and the lower nest 20 are respectively provided with a nest hole 41 extending along the longitudinal direction. The first umbrella sub-rib fixed end is hinged to the nest hole 41 in the upper nest 19. The first umbrella sub-rib 25 can be rotated around the hinge point. It is understood that, the hinged manner may be a hinge hole engaging with a hinge pin. For example, the first umbrella sub-rib fixed end comprises a hinge hole, and the corresponding nest hole of the upper nest 19 is provided with a hinge pin, the hinge pin passes through the hinge hole to secure the first umbrella sub-rib fixed end to the upper nest. Likewise, a second umbrella sub-rib fixed end of the second umbrella sub-rib 30 is hinged to the nest hole 41 in the lower nest 20 and can be rotated around the corresponding hinge point. The supporting rib fixed end of the supporting rib 27 is hinged to the nest hole 41 of the lower nest 20. The supporting rib 27 can be rotated around the corresponding hinge point. Wherein, the position where the second umbrella sub-rib 30 is hinged with the lower nest 20 is lower than the position where the supporting rib fixed end of the supporting rib 27 is hinged with the lower nest 20. As mentioned above, the hinged manner between the first umbrella sub-rib 25 and the upper nest 19 is also adapted to hinge the second umbrella sub-rib 30, the supporting rib 27 and the lower nest 20, and therefore will not be repeated here.

Referring to FIG. 2, In some embodiments, the first umbrella sub-rib free end of the first umbrella sub-rib 25 is connected with the traction element 33 via the fourth hinge point 32. The traction element 33 is provided with a through hole. The fourth hinge point 32 may be of a structure in which a shaft and a hole are engaged, so the traction element 33 can be rotated around the fourth hinge point 32. The first hinge point 28 is provided on the first umbrella sub-rib 25, adjacent the first umbrella sub-rib free end of the first umbrella sub-rib 25 and above the fourth hinge point 32. The reverse-folding umbrella rib fixed end of the reverse-folding umbrella rib 26 is hinged together with the first umbrella sub-rib 25 via the first hinge point 28. The reverse-folding umbrella rib can be rotated around the first hinge point 28. The reverse-folding umbrella rib free end of the reverse-folding umbrella rib 26 is hinged to the second umbrella sub-rib free end of the second umbrella sub-rib 30 via the third hinge point 31. The second umbrella sub-rib 30 can be rotated around the third hinge point 31. Furthermore, the second umbrella sub-rib 30 passes through the through hole on the traction element 33. Through the through hole, distance between the second umbrella sub-rib 30 and the first umbrella sub-rib 25 when the umbrella is in an opening or closing state could be limited.

Referring to FIG. 2 and FIG. 3, in some embodiments, the upper nest 19 is located over the outer sleeve upper end of the outer sleeve 11. The connection manner between the upper nest 19 and the outer sleeve 11 may be in a tight fit, or a threaded connection. The first pulley component 21 is secured to a top end of the middle rod 10 via a first pulley sleeve 211. Two ends of the first pulley sleeve 211 are located into the upper nest 19 and a cavity of the outer sleeve 11 respectively. The first pulley sleeve 211 may be of a long tubular structure.

In some embodiments, a first pulley 212 and a second pulley 213 fixedly connected with the first pulley sleeve 211 may further be arranged in the first pulley component 21. A second opening 112 and a third opening 113 are formed at positions close to the outer sleeve upper end of the outer sleeve 11. A fifth opening 211A and a sixth opening 211B are formed on the first pulley sleeve 211 and corresponding to the second opening 112 and the third opening 113. The nest-connecting end of the line 24, after being threaded through the first pulley 212 and the second pulley 213, extends out of the outer sleeve 11 via the second opening 112 and fifth opening 211A. In some embodiments, the pulley-connecting end of the line 24 extends out of the outer sleeve 11 via the third opening 113 and sixth opening 211B, and connects to the lower pulley assembly 22. In some embodiments, the nest-connecting end of the line 24 goes through the outer sleeve along a vertical direction and connects the lower pulley assembly 22

Referring to FIG. 1, FIG. 2 and FIG. 5 to FIG. 7, the lower pulley assembly 22 comprises a tighten-up set 34, a second pulley component 35, and a third pulley component 36. The tighten-up set 34 is held and fixed in the movable sleeve 16. The second pulley component 35 is capable of being moved along the longitudinal direction and comprises a second pulley component upper end abutting against the long rod 15 and a second pulley component lower end abutting against the tighten-up set 34. The third pulley component 36 is disposed on the tighten-up set 34. The second pulley component 35 comprises a third pulley 352, and the third pulley component 36 comprises a sixth pulley 362 and a fixed column 361. The line 24 extending downwards, via the first pulley component 21, from the lower nest 20 continues to extend upwards via the sixth pulley 362, and then extends downwards via the third pulley 352 to be connected with the fixed column 361 on the third pulley component 36.

Figure 6:
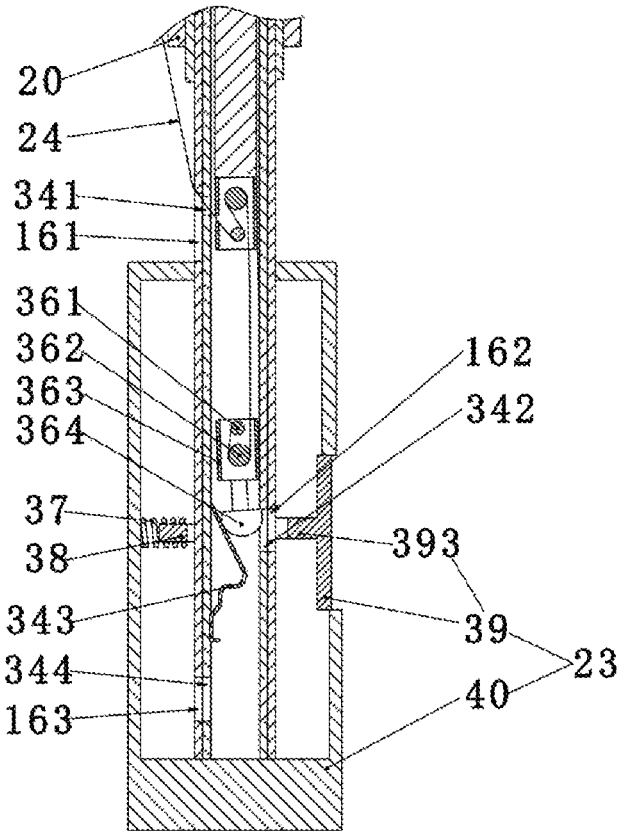

The movable sleeve 16 may be detached from the first limiting element 38 disposed on the drive mechanism 23 and move downwards under the pressure from the first elastic element 14 when a button 39 disposed on the drive mechanism 23 is pressed. At this moment, the third pulley component 36 is moved downwards along with the movable sleeve 16 and the second pulley component 35 stays still. One end, fixedly connected with the fixed column 361, of the line 24 is moved downwards under the driving of the third pulley component 36. The movement of the line 24 drives the lower nest 20 to move upwards, thereby opening the umbrella. When the umbrella is opened, a lower nest upper end of the lower nest 20 is propped against an upper nest lower end of the upper nest 19 and pulls the movable sleeve 16 via the third pulley component 36 which is connected with the pulley-connecting end of the line 24, so that the movable sleeve 16 will not move downwards excessively. Likewise, in some embodiments, when the umbrella is opened, the lower end of the movable sleeve 16 is abutted against a bottom sidewall of the housing 40, so that the movable sleeve 16 will not move downwards any further. As shown in FIG. 6, at this moment, when the button on the drive mechanism 23 is pressed again, the third pulley component 36 is secured to a fourth limiting slot 342 formed on the tighten-up set 34 when the first elastic element 14 is restored to a compression state and is detached from the fourth limiting slot 342 when being pressed by the button 39.

Figure 5:
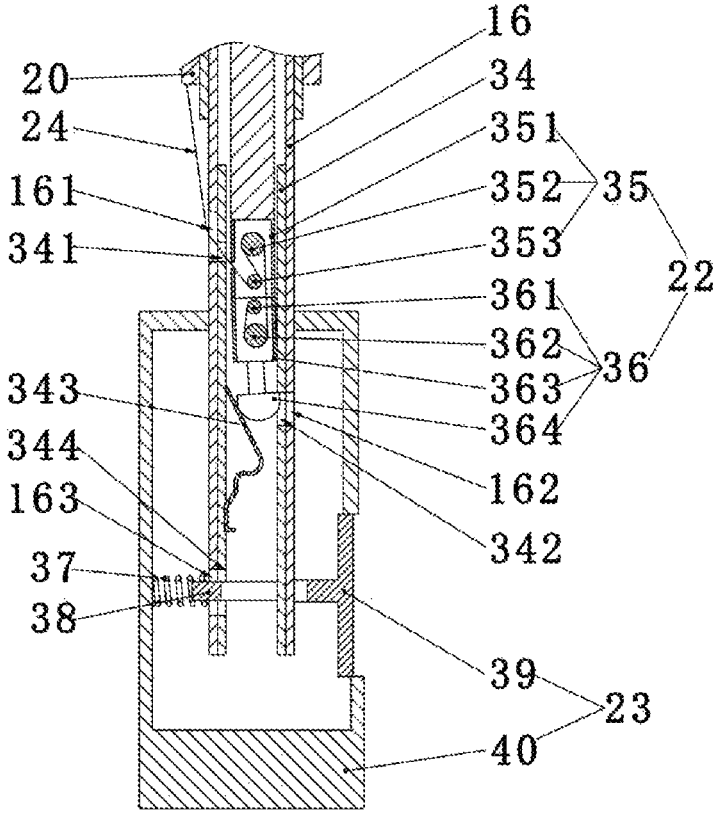
FIG. 5, FIG. 6 and FIG. 7 are a structural schematic diagram of a drive mechanism and a movable sleeve in a first embodiment of the present disclosure.
Figure 7:
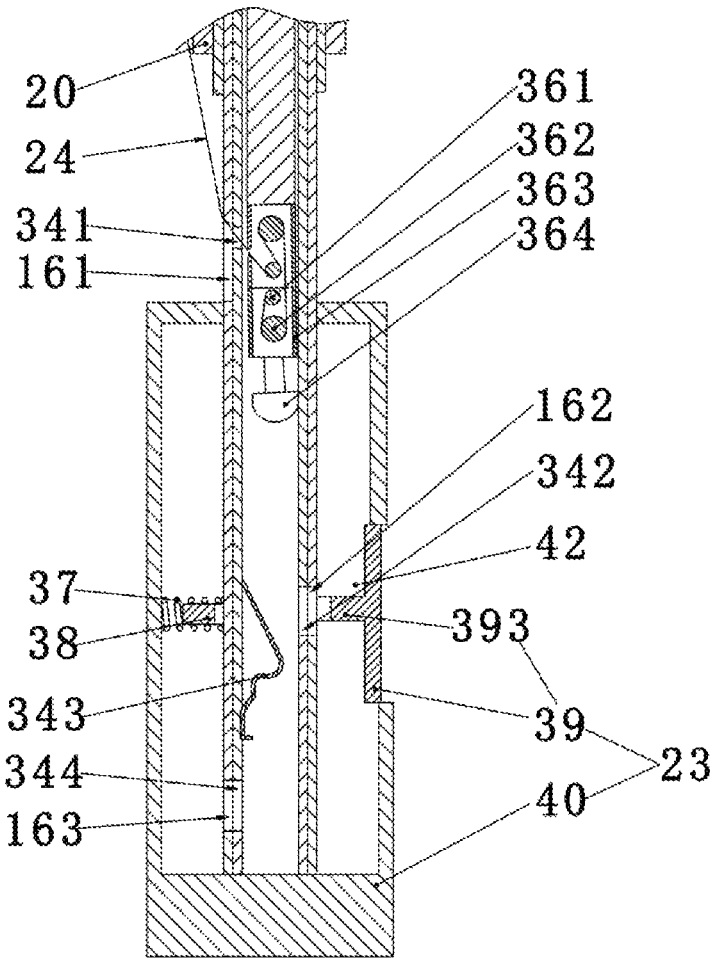
Figure 8:
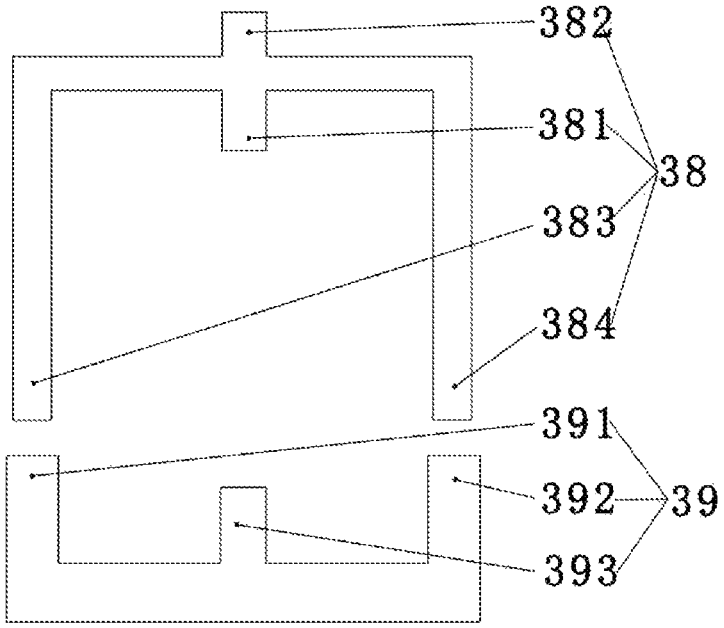
FIG. 8 is a structural schematic diagram of a first limiting element and a button of the present disclosure.

Referring to FIG. 5 to FIG. 7, in some embodiments, the tighten-up set 34 is firmly connected to a cavity of the movable sleeve 16. The long rod lower end of the long rod 15 is inserted into the tighten-up set 34 and abuts a second pulley component upper end of the second pulley component 35. The second pulley component comprises a second pulley component sleeve 351 which is of a long tubular structure, as well as a third pulley 352 and a fourth pulley 353 connected with the second pulley component sleeve 351. The third pulley component 36 held in the tighten-up set 34 is disposed at a lower side of the second pulley component 35. The third pulley component 36 comprises a third pulley component sleeve 363, which is of a long tubular structure, as well as the fixed column 361 and the sixth pulley 362 connected with the third pulley component sleeve 363. An opening is formed on the second pulley component sleeve 351. A fourth opening 341 is formed at a position, corresponding to the opening formed on the second pulley component sleeve 351, on the tighten-up set 34. Furthermore, a first opening 161 is formed at a position, corresponding to the fourth opening 341, on the movable sleeve 16. The nest-connecting end of the line 24 passes through the first opening 161, the fourth opening 341, and the opening on the second pulley component 35 in a sequence. The pulley-connecting end of the line 24 is threaded through the fourth pulley 353, and then the third pulley 352, then the sixth pulley 362, and at last firmly attached to the fixed column 361. It could be understood that, the fixed column 361 may be of a structure for the line 24 to thread through, for example, a pulley.

Referring to FIG. 5 to FIG. 8, a drive mechanism 23 is located over the periphery of the movable sleeve 16. The drive mechanism 23 comprises a housing 40, a holding groove, and a button 39. The holding groove is capable of holding and limiting the first limiting element 38 to move along a direction perpendicular to the longitudinal direction. The button 39 disposed on the housing 40 is capable of being pressed from outside and abutted against an active end of the first limiting element 38. A passive end of the first limiting element 38, along a movement direction, is symmetrically provided with a first protrusion portion 381 and a second protrusion portion 382. The first protrusion portion 381 is capable of being secured to a fifth limiting slot 344 formed on the movable sleeve 16. The second protrusion portion 382 is arranged to abut against the housing 40.

Referring to FIG. 5 to FIG. 8, a third clamping block 364, which is T-shaped, is arranged at a third pulley lower end of the third pulley component 36. A fourth limiting slot 342 is formed on the tighten-up set 34. A sixth limiting slot 162 corresponding to the fourth limiting slot 342 is formed on the movable sleeve 16. The third clamping block 364 can be secured to an upper periphery of the fourth limiting slot 342. A second limiting element 343 comprising a slope inclined to a direction of the fourth limiting slot 342 from top to bottom is arranged at a position, opposite to the fourth limiting slot 342, in the tighten-up set 34. Through the slope on the second limiting element 343, the third clamping block 364 can be secured to the fourth limiting slot 342. Wherein, the second limiting element 343 is firmly connected with the tighten-up set 34. The second limiting element 343 has a certain plastic deformation capacity and may be made of a plastic or a metal piece. A seventh limiting slot 163 is formed at a position, located at a lower side of the second limiting element 343, on the movable sleeve 16. The first limiting element 38 disposed on the drive mechanism 23 is provided with the first protrusion portion 381 which is capable of being secured to the seventh limiting slot 163. A third elastic element 37 is disposed between a back portion of the first protrusion portion 381 and the housing 40 of the drive mechanism 23. The back portion of the first protrusion portion 381 is provided with the second protrusion portion 382 passing through a middle of the third elastic element 37. The second protrusion portion 382 may limit the third elastic element 37. The first limiting element 38 further comprises a first pressure portion 383 and a second pressure portion 384 at both left and right sides. The first pressure portion 383 and the second pressure portion 384 pass through two edges of an outside of the movable sleeve 16 and together receive the movable sleeve 16 inside. The button 39 is arranged on a position, opposite to the third elastic element 37, on the housing 40. The button is further provided with a first pressing portion 391 and a second pressing portion 392. The first pressing portion 391 and the second pressing portion 392 respectively abut the first pressure portion 383 and the second pressure portion 384. An opening for passing through the button 39 is formed on the housing 40. When a user presses the button 39, the first limiting element 38 could be enabled to press the third elastic element 37 and move along a compressed direction of the third elastic element. The first protrusion portion 381 is detached from the seventh limiting slot 163, and the movable sleeve 16 could be moved along the longitudinal direction. Furthermore, a fifth limiting slot 344 is formed at a position, corresponding to the seventh limiting slot 163, on the tighten-up set 34. In this way, the first protrusion portion 381 will not be interfered by the tighten-up set 34.

Referring to FIG. 1, FIG. 2 and FIG. 5 to FIG. 8, in the compressed state, the first elastic element 14 is completely compressed and the position of the button 39 is corresponding to the position of the first limiting element 38. After the button 39 is pressed, the movable sleeve 16 is moved downwards along the longitudinal direction under the pressure from the first elastic element 14, and pulls the third pulley component 36 to move downwards until the upper end of the lower nest 20 is abutted against the lower end of the upper nest 19. At this moment, the umbrella is opened. The state of the drive mechanism 23 of the umbrella and the movable sleeve can be seen in FIG. 6. Furthermore, the second umbrella sub-ribs 30 will be squeezed by the lower nest 20 and the reverse-folding umbrella rib 26. The lower nest 20 and the reverse-folding umbrella rib 26 are respectively connected to the second umbrella sub-rib 30. In this position, the second umbrella sub-rib 30 will not be bent and deformed to the lower sides due to the traction element 33. In a state when the umbrella is opened, the position of the third pressing portion 393 arranged on the button 39 is corresponding to the fourth limiting slot 342 and the sixth limiting slot 162. The button 39 is pressed so that the third clamping block 364 is moved under the pressing of the third pressing portion 393 and is further detached from the fourth limiting slot 342. In this position, the line 24 is no longer in a tensed state, and the lower nest 20 is moved downwards due to the pressure from the second umbrella sub-ribs 30. The state of the drive mechanism 23 of the umbrella and the movable sleeve can be seen in FIG. 7. By applying an upward force to the drive mechanism 23, the movable sleeve 16 will compress the first elastic element 14 and move upwards until the third clamping block 364 is secured to the fourth limiting slot 342 again. The first elastic element 14 then will in the compressed state again. The state of the drive mechanism 23 of the umbrella and the movable sleeve can be seen again as shown in FIG. 5.

The present disclosure further provides an automatic umbrella (not shown), which comprises the automatic umbrella frame, an outer umbrella cloth, and an inner umbrella cloth. The outer umbrella cloth covers the first umbrella sub-ribs 25 and the reverse-folding umbrella ribs 26. The outer umbrella is secured to upper sides of first umbrella sub-ribs 25 and reverse-folding umbrella ribs 26. The inner umbrella cloth covers the lower sides of the second umbrella sub-ribs 30. The inner umbrella cloth is secured to the second umbrella sub-ribs 30. The outer umbrella cloth completely covers the inner umbrella cloth when the umbrella is opened. The outer umbrella cloth can be connected to the first umbrella sub-ribs 25 and the reverse-folding umbrella ribs 26 together in a sewing manner. Likewise, the inner umbrella cloth can be connected to the second umbrella sub-ribs 30 together in the sewing manner.

In some embodiments, the first elastic element 14 and the third elastic element 37 may both be springs.

Figure 9:
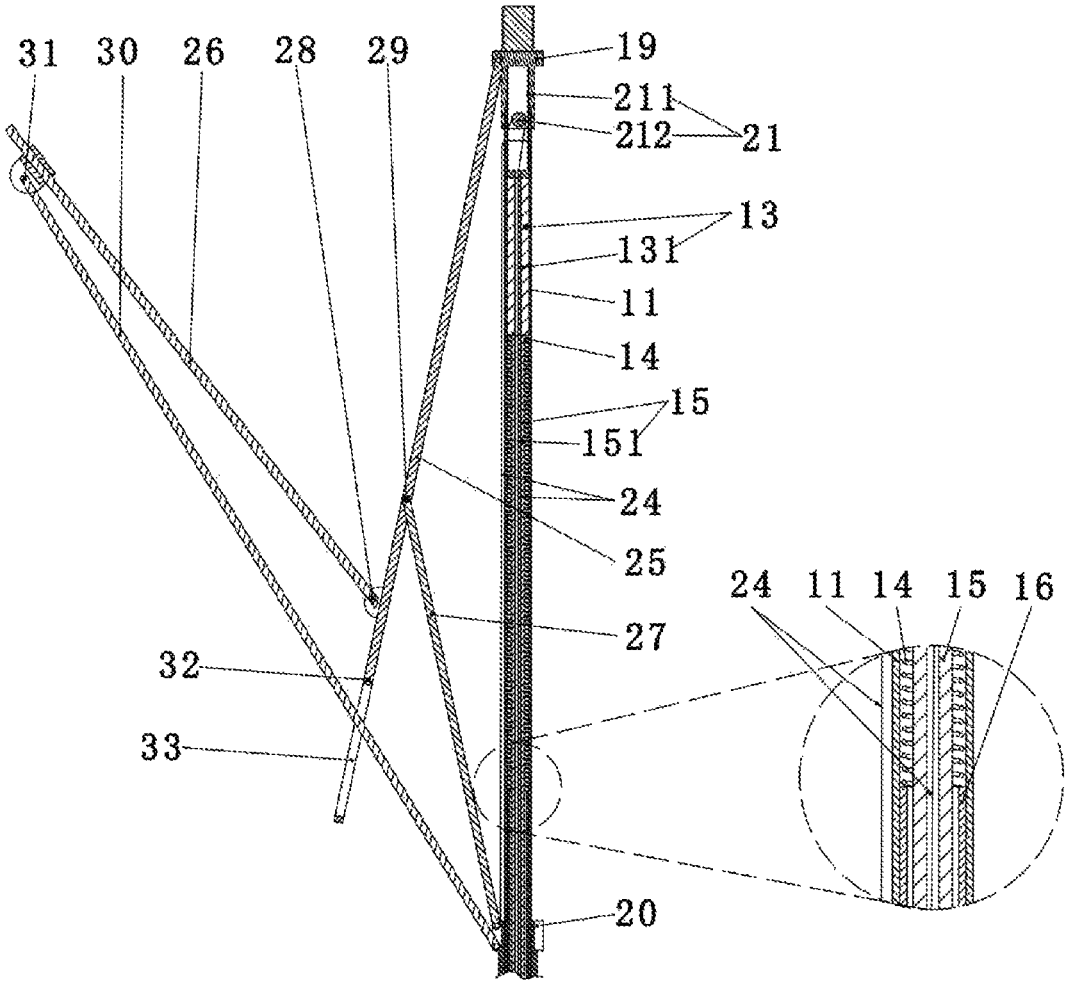
FIG. 9 and FIG. 10 are a structural schematic diagram of an umbrella frame in second and third embodiments of the present disclosure.
Figure 10:
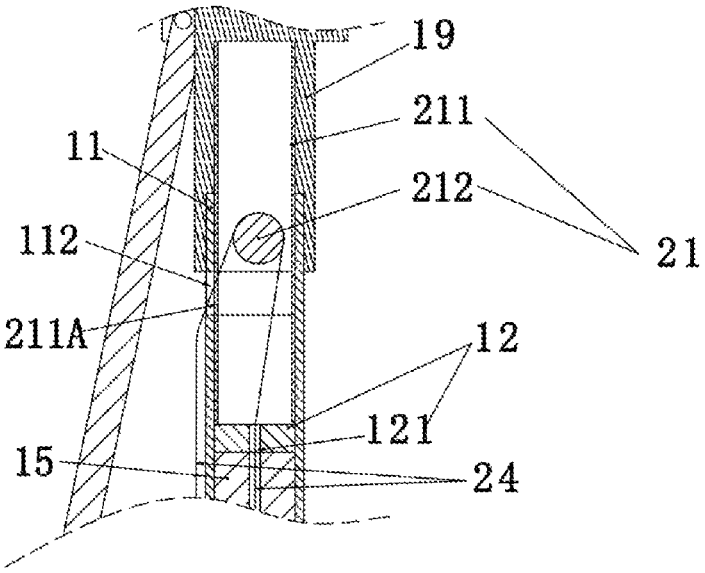
Figure 11:
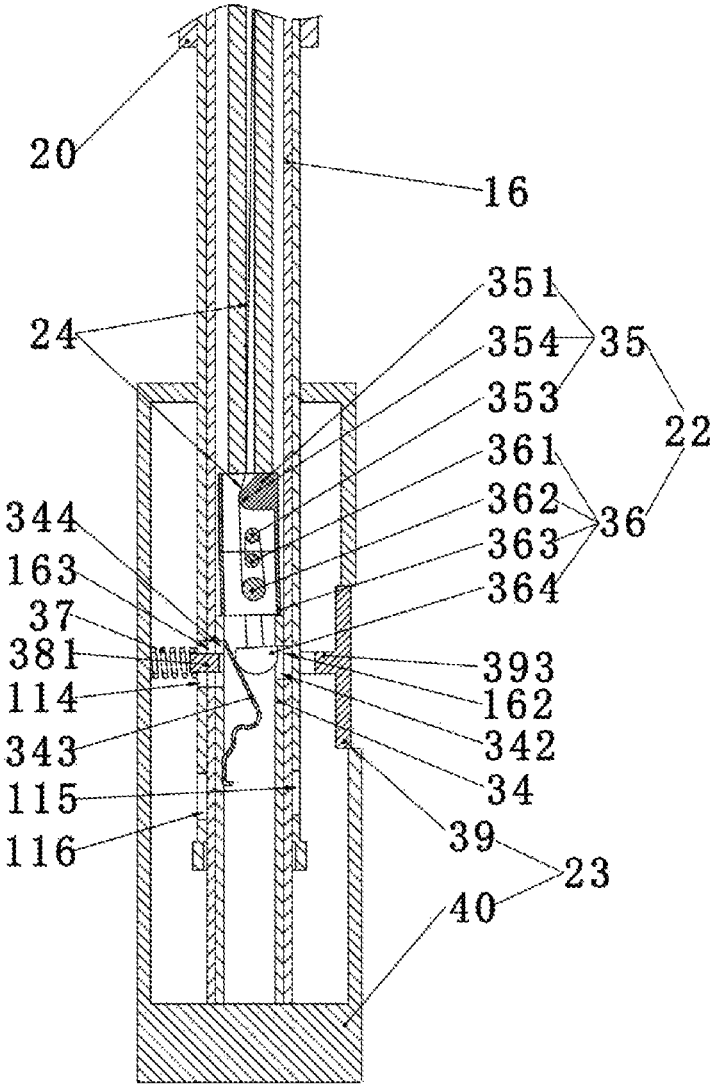
FIG. 11 and FIG. 12 are a structural schematic diagram of a drive mechanism and a movable sleeve in a second embodiment of the present disclosure.

Referring to FIG. 9, FIG. 10, FIG. 11 and FIG. 12, the present disclosure further provides an embodiment. Different from the first embodiment described above, in the other embodiments, as shown in FIG. 9 and FIG. 10, a first pulley 212 connected with the first pulley sleeve 211 is arranged within the first pulley component 21. A second opening 112 is formed at a position close to the upper end of the outer sleeve 11. As shown in FIG. 11, an outer wall of the first pulley sleeve 211 comprises a fifth opening 211A corresponding to the second opening 112. The line is threaded through the first pulley 212, and then passes the locating element 12, the adjustment element 13, and the long rod 15 until attaching to the lower pulley assembly 22. It is understood that, the locating element 12, the adjustment element 13, and the long rod 15 may be of a hollow structure in order to enable the line 24 to pass through the locating element 12, the adjustment element 13, and the long rod 15. As shown in FIG. 11, at top of a cavity of the second pulley component 35, a third limiting block 354 which is dome-shaped is provided. The line 24 is threaded through a sixth pulley 362 via the third limiting block 354, then a fourth pulley 353, and at last anchored to the fixed column 361. The second pulley component upper end of the second pulley component 35 is connected with the long rod lower end of the long rod 15. A diameter of the sixth pulley 362 is greater than that of the fixed column 361 and the fourth pulley 353, so it may be assured that when the line 24 is respectively threaded through the third limiting block 354, the sixth pulley 362, the fourth pulley 353, and the fixed column 361. The line 24 will not interfere with itself due to change of direction. The outer sleeve lower end of the outer sleeve 11 extends downwards into the drive mechanism 23, and the movable sleeve lower end of the movable sleeve 16 is abutted against a wall at a bottom of a cavity of the drive mechanism 23.

Figure 12:
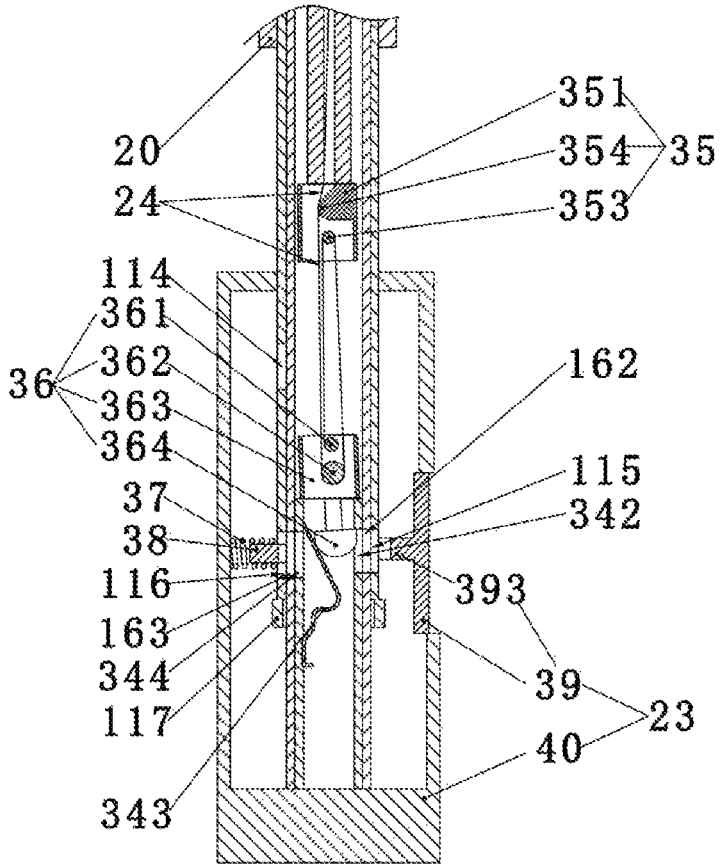

In the second embodiment, as shown in FIG. 11, the first elastic element 14 is completely compressed and the position of the button 39 is corresponding to the position of the first limiting element 38 when the first elastic element 14 is in a compressed state. An eighth limiting slot 114 is formed at a position, corresponding to the seventh limiting slot 163 and the fifth limiting slot 344, on the outer sleeve 11. The first protrusion portion 381 respectively passes through the eighth limiting slot 114, the seventh limiting slot 163, and the fifth limiting slot 344 and is anchored to the outer sleeve 11. When the button 39 is pressed for the first time, the outer sleeve 11 is detached from the limiting of the first protrusion portion 381 and is moved upwards along the longitudinal direction under the pressure from the first elastic element 14. Furthermore, the third pressing portion 393 is blocked by the outer sleeve 11 and will not pass through the sixth limiting slot 162 and the fourth limiting slot 342. The upward movement of the outer sleeve 11 drives each component fixedly connected with the outer sleeve 11 to move upwards together. While at the same time, the movable sleeve 16 and each component connected with the movable sleeve 16 keeps being abutted against the lower end of the cavity of the drive mechanism due to the downward force from the first elastic element 14 applying against the movable sleeve upper end of the movable sleeve 16. The third clamping block 364 is still secured to the fourth limiting slot 342. The second pulley component 35 connected with the long rod 15 is moved upwards along with the outer sleeve 11 which is connected with the long rod 15. The second pulley component 35 is far away from the third pulley component 36 fixed on the movable sleeve 16. The line 24, which is threaded through the second pulley component 35 and the third pulley component 36, pulls the lower nest 20 upwards via the first pulley 212 until the first protrusion portion 381 is secured to a tenth limiting slot 116 formed close the outer sleeve lower end under the pressure from the third elastic element 37, in order to compensate the travel required by the second pulley component 35 being far away from the third pulley component 36, and thereby finishing the umbrella opening operation. As shown in FIG. 12, when the umbrella is opened, a ninth limiting slot 115 is formed on a position, corresponding to the sixth limiting slot 162, on the outer sleeve 11. The tenth limiting slot 116 is formed on a position, corresponding to the seventh limiting slot 163, on the outer sleeve 11. The position of the third pressing portion 393 is corresponding to the ninth limiting slot 115, the sixth limiting slot 162 and the fourth limiting slot 342. When the button 39 is pressed for the second time, the third pressing portion 393 respectively passes through the ninth limiting slot 115, the sixth limiting slot 162, and the fourth limiting slot 342 in sequence and applies a force to the third clamping block 364, so that the third limiting block is detached from the limiting with the tighten-up set 34. At this moment, the line 24 will not in the tensed state and the lower nest 20 is moved downwards for the pressure from the second umbrella sub-ribs 30. Furthermore, the third pulley component 36 is moved upwards due to a tensile force of the line 24 until the third pulley component upper end of the third pulley component is abutted against the second pulley component lower end of the second pulley component 35, thereby finishing the umbrella closing operation. Furthermore, after the outer sleeve 11 is fixed, a force is applied to the drive mechanism 23 so that the drive mechanism 23 is moved upwards relative to the outer sleeve 11 until the third clamping block 364 is secured to the fourth limiting slot again and the first elastic element 14 is restored to the compressed state for the next opening operation. In some embodiments, reaming processing is performed on the outer sleeve lower end of the outer sleeve 11. During the reaming process, the periphery of the outer sleeve lower end is protruded outwards and deformed due to its plasticity and produce a reaming portion 117 protruded outwards along the periphery, as shown in the FIG. 12. The reaming portion 117 can be secured to the first protrusion portion 381 when the button 39 is pressed for the second time, thereby limiting a movement distance of the first protrusion portion 381. It could be understood that, the outer sleeve 11 in some embodiments may be made of a material with plastic deformation, for example, metal or plastic.

Figure 13:
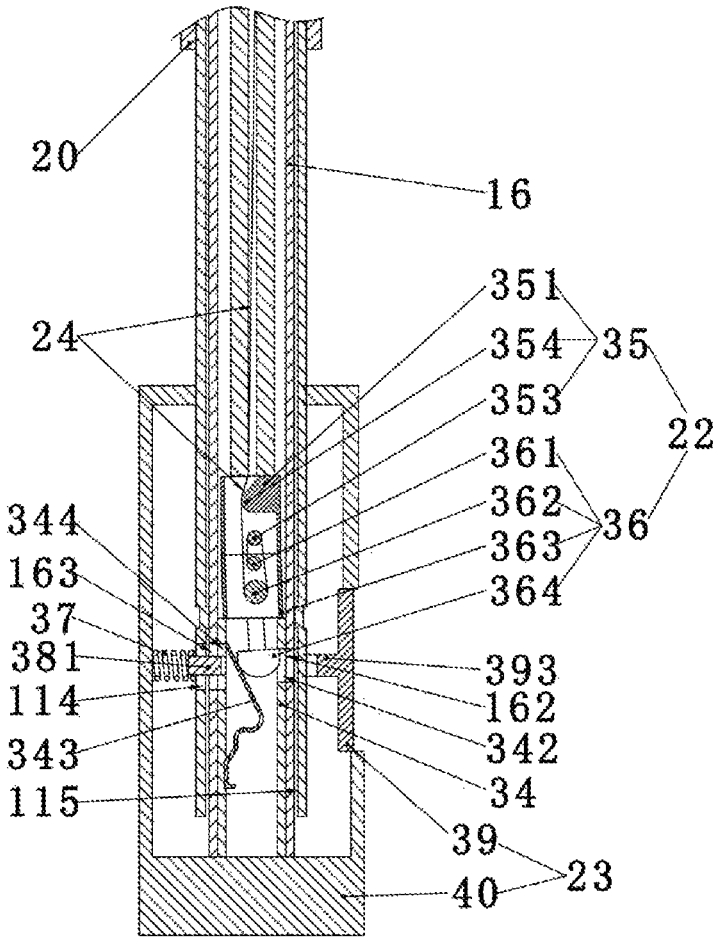
FIG. 13 and FIG. 14 are a structural schematic diagram of a drive mechanism and a movable sleeve a third embodiment of the present disclosure.
Figure 14:
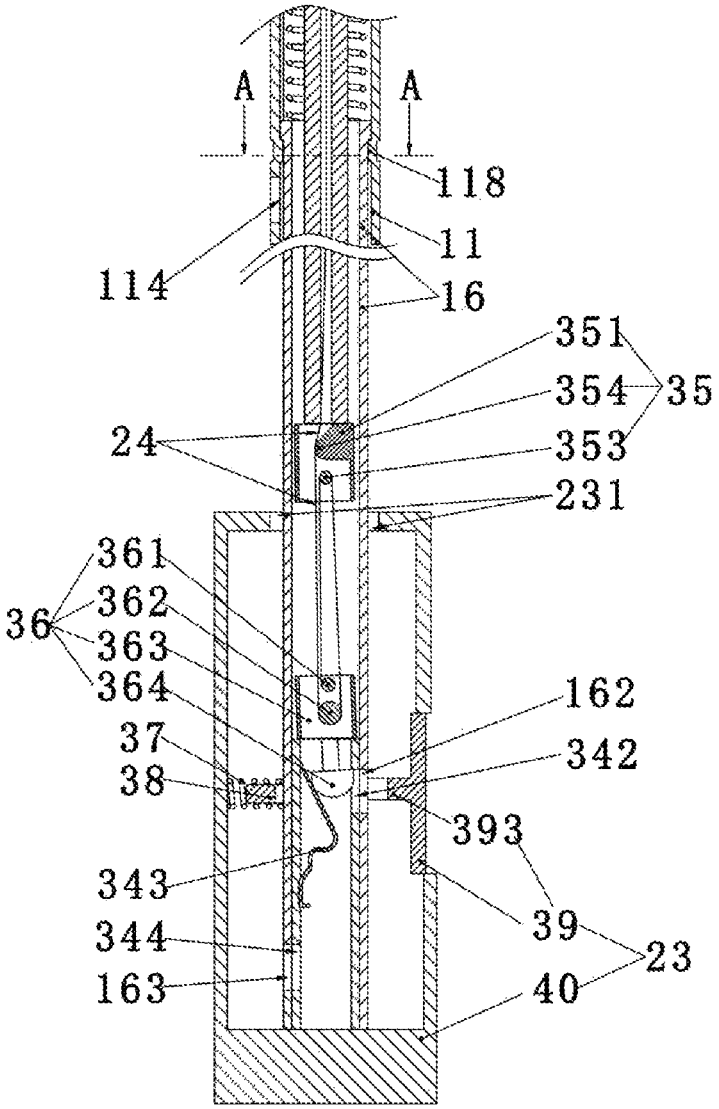
Figure 15:
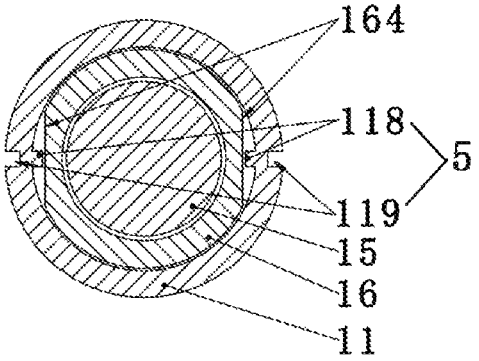
FIG. 15 is a structural schematic diagram sectioning at an A-A place in FIG. 14 of the present disclosure.

Referring to FIG. 9, FIG. 10, FIG. 13, FIG. 14 and FIG. 15, in some embodiments, as shown in FIG. 9 and FIG. 10, a first pulley 212, connected with the first pulley sleeve 211, is arranged in the first pulley component 21. A second opening 112 is formed at a position close to the outer sleeve upper end of the outer sleeve 11. As shown in FIG. 10, an outer wall of the first pulley sleeve 211 comprises a fifth opening 211A corresponding to the second opening 112. After being threaded through the first pulley 212, the line passes through the locating element 12, the adjustment element 13, the long rod 15, and at last attaches to the lower pulley assembly 22. It could be understood that, in order to enable the line 24 to be threaded through the locating element 12, the adjustment element 13, and the long rod 15 in sequence, the locating element 12, the adjustment element 13, and the long rod 15 may be of a hollow structure. As shown in FIG. 13, a third limiting block 354 which is dome-shaped is provided at top of a cavity of the second pulley component 35. The line 24 is threaded through a sixth pulley 362 via the third limiting block 354, then is a fourth pulley 353, and at last secured to the fixed column 361. The fixed column 361, in some embodiments, may be a fifth pulley which is fixed. The second pulley component upper end of the second pulley component 35 is connected with the long rod lower end of the long rod 15. A diameter of the sixth pulley 362 is greater than that of the fixed column 361 and the fourth pulley 353, so the line 24 will not interfere itself due to a change of direction when the line 24 is threaded through the third limiting block 354, the sixth pulley 362, the fourth pulley 353, and the fixed column 361. The outer sleeve lower end of the outer sleeve 11 extends downwards into the drive mechanism 23, and the movable sleeve lower end of the movable sleeve 16 is abutted against a wall at a lower end of a cavity of the drive mechanism 23. A deformation portion 5, extending along the longitudinal direction and sunken toward the cavity of the outer sleeve 11, is formed at a position close to the lower end of the outer sleeve 11. As shown in FIGS. 13-15, the deformation portion 5 may comprise a third protrusion portion 118 and the sunken portion 119. The outer sleeve 11 may be stamped using a stamping method so that the outer sleeve 11 forms the third protrusion portion 118 and the sunken portion 119. The third protrusion 118 is protruded toward the cavity of the outer sleeve 11, and the sunken portion 119 sinks inwards from the periphery of the outer sleeve 11 and extending along the longitudinal direction. A chute 164, in which the third protrusion portion 118 is moved along the longitudinal direction, is formed on the movable sleeve 16 along the longitudinal direction. Likewise, the chute 164 may be molded in the movable sleeve 16 using a stamping manner.

In some embodiments, as shown in FIG. 12, in the compressed state, the first elastic element 14 is completely compressed and the position of the button 39 is corresponding to the position of the first limiting element 38. An eighth limiting slot 114 is formed at a position, corresponding to the seventh limiting slot 163 and the fifth limiting slot 344, on the outer sleeve 11. The first protrusion portion 381 passes through the eighth limiting slot 114, the seventh limiting slot 163, and the fifth limiting slot 344 and anchors to the outer sleeve 11. When the button 39 is pressed for the first time, the outer sleeve 11 is detached from the limiting of the first protrusion portion 381 and is moved upwards along the longitudinal direction under the pressure from the first elastic element 14. Furthermore, the third pressing portion 393 is blocked by the outer sleeve 11 and will not pass through the sixth limiting slot 162 and the fourth limiting slot 342. The upward movement of the outer sleeve 11 drives each component fixedly connected with the outer sleeve 11 to move upwards. The movable sleeve 16 and each component connected with the movable sleeve 16 keeps being abutted against the lower end of the cavity of the drive mechanism. The third clamping block 364 is still secured to the fourth limiting slot 342. The second pulley component 35 connected with the long rod 15 is moved upwards when the long rod 15 is moved upwards along with the outer sleeve 11 connected with the long rod 15. The second pulley component 35 is far away from the third pulley component 36 fixed on the movable sleeve 16. The line 24, which is threaded through the second pulley component 35 and the third pulley component 36, pulls the lower nest 20 upwards via the first pulley 212 until the protrusion portion upper end of third protrusion portion 118 is abutted against the movable sleeve upper end of the movable sleeve 16 under the pressure from the third elastic element 37, in order to compensate the travel required by the second pulley component 35 being far away from the third pulley component 36. It could be understood that, a through hole 231, capable of holding the outer sleeve 11 to move up and down relative to the outer sleeve, is formed at an upper side of the drive mechanism 23. When the umbrella is opened, the position of the third pressing portion 393 is corresponding to the sixth limiting slot 162 and the fourth limiting slot 342. When the button 39 is pressed for the second time, the third pressing portion 393 passes through the sixth limiting slot 162, and the fourth limiting slot 342 in sequence and applies a force to the third clamping block 364, so that the third limiting block is detached from the limiting with the tighten-up set 34. The line 24 then will be changed into a loose state from the tensed state, and the lower nest 20 will be moved downwards from the pressure from the second umbrella sub-ribs 30. Furthermore, the third pulley component 36 is moved upwards due to a tensile force from the line 24 until the third pulley component upper end of the third pulley component abuts the second pulley component lower end of the second pulley component 35. Further, after the outer sleeve 11 is fixed, a force is applied to the drive mechanism 23 so that the drive mechanism is moved upwards relative to the outer sleeve 11 until the third clamping block 364 is secured to the fourth limiting slot again and the first elastic element 14 is restored to the compressed state for a next opening of the umbrella.

It could be understood that, in some embodiments, reaming processing may be performed on the movable sleeve upper end of the movable sleeve 16, so that the periphery of the movable sleeve upper end of the movable sleeve 16 is protruded outwards and is located into the outer sleeve 11. After the movable sleeve 16 is located into the outer sleeve 11, the outer sleeve lower end of the outer sleeve 11 is stamped to mold the third protrusion portion 118 and the sunken portion 119. Likewise, when the outer sleeve 11 is moved upwards, the movable sleeve upper end of the movable sleeve 16 is abutted against a lower end of an outward protrusion portion at the outer sleeve upper end of the outer sleeve 11, so that the outer sleeve 11 stops the movement and the umbrella opening operation is finished. Likewise, it may be understood that, the outer sleeve 11 in some embodiment may be made of a material with plastic deformation such as a metal piece or a plastic piece.

Figure 16:
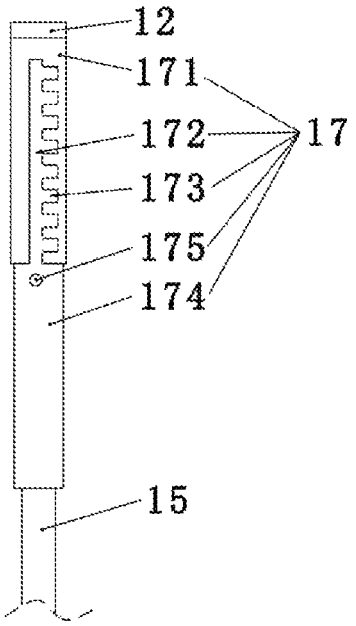
FIG. 16, FIG. 18 and FIG. 19 are a structural schematic diagram of an adjustment element and deformation thereof in a fourth embodiment of the present disclosure.
Figure 17:
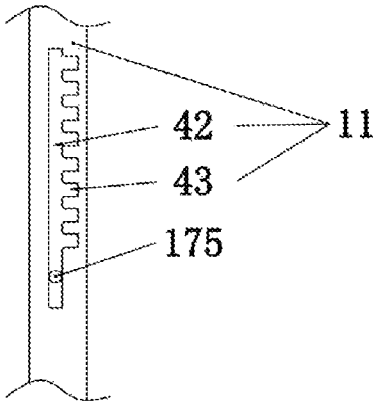
FIG. 17 is a structural schematic diagram, in which an outer sleeve is corresponding to a position of an adjustment element, in a fourth embodiment of the present disclosure.
Figure 18:
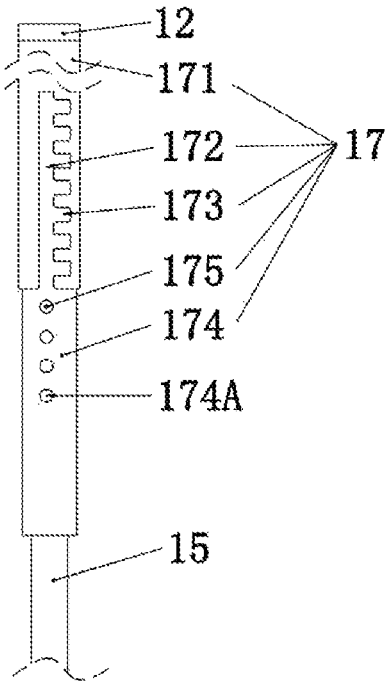
Figure 19:
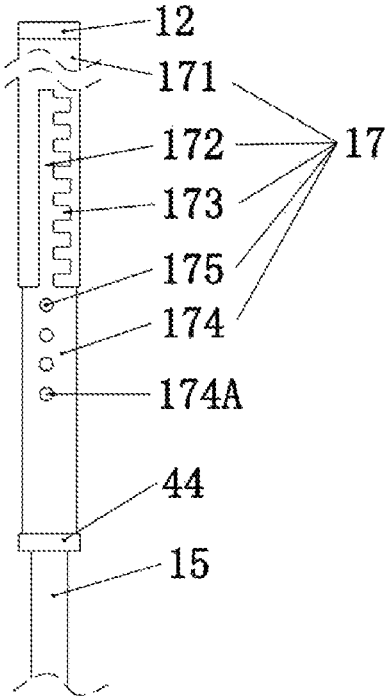
Figure 20:
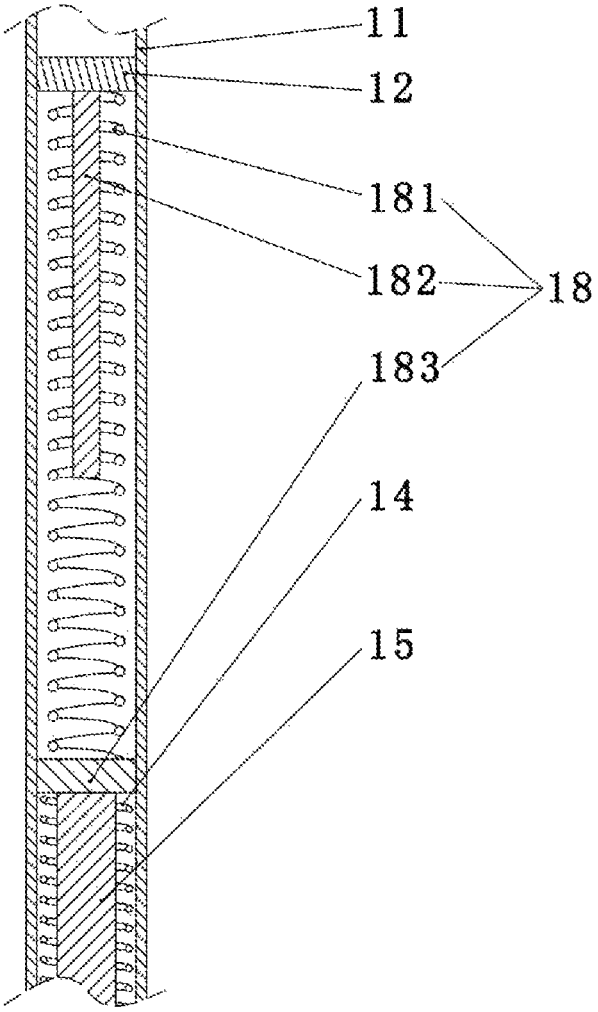
FIG. 20 to FIG. 22 are structural schematic diagrams of an adjustment element and deformation thereof at a P place of FIG. 1 in a fifth embodiment of the present disclosure.
Figure 21:
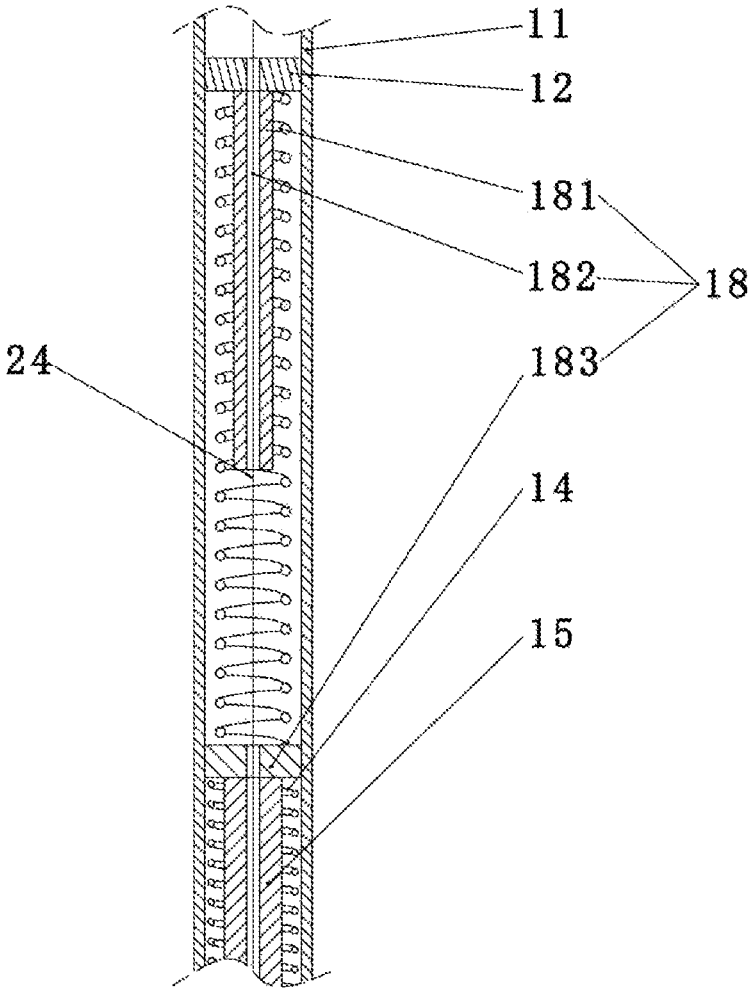

Referring to FIG. 1, FIG. 16, FIG. 17, FIG. 18 and FIG. 19, the present disclosure further provides a middle structure of an automatic umbrella. (FIG. 16, FIG. 18 and FIG. 19 are structural schematic diagrams of a variation of an adjustment element 13 in FIG. 1). In some embodiments, the adjustment element 17 comprises an adjustment sleeve 171 and an adjustment rod 174. The adjustment sleeve 171 comprises an outer edge extended longitudinally and connected with the outer sleeve 11. The adjustment rod 174 comprises the adjustment sleeve upper end located inside the adjustment sleeve 171 and capable of being moved up and down and rotated peripherally relative to the adjustment sleeve 171. A first limiting slot 172, wherein the first limiting slot is provided from outer surface to inner surface of the adjustment sleeve 171 and extends along the longitudinal direction, is formed on a circumference of the adjustment sleeve 171. Multiple second limiting slots 173, communicating with the first limiting slot 172 and extending along the periphery, are formed at the first limiting slot side edge along the longitudinal direction. An adjustment rod lower end of the adjustment rod 174 is abutted against the long rod upper end of the long rod 15. A protruding first limiting block 175 is arranged on an outer circumference of the adjustment rod 174. The first limiting block 175 is secured to any second limiting slot 173 by sliding along the first limiting slot 172 and rotating relative to the adjustment sleeve 171. The adjustment rod 174 can be pulled via the first limiting block 175 to move up and down along the first limiting slot 172. The adjustment rod 174 is rotated via the first limiting block 175 so that the first limiting block 175 is secured to one of the multiple second limiting slots 173 to adjust the length of the adjustment element 17. Therefore, the adjustment element 17 can be used in different lengths of the middle rods 10. That is, the requirements on different sizes of the umbrellas can be met. As shown in FIG. 17, an eleventh limiting slot 42 and a twelfth limiting slot 43 are also formed at positions, corresponding to the first limiting slot 172 and the second limiting slot 173, at the periphery of the outer sleeve 11. The first limiting block 175 may be moved along the eleventh limiting slot 42 and the twelfth limiting slot 43 under an external force and is secured to a lower side of either the eleventh limiting slot 42 or the twelfth limiting slot 43.

In some embodiments, as shown in FIG. 18, multiple first limiting block fixing holes 174A are transversally penetrated through the adjustment rod 174. The first limiting block fixing holes are formed on the adjustment rod 174 along the longitudinal direction. The first limiting block 175 may be a locating pin and the first limiting block 175 is inserted into the first limiting block fixing holes 174A. It may be understood that, the first limiting block fixing holes 174A and the first limiting block 175 are in tight fit, so that the first limiting block fixing holes 174A may be secured on the first limiting block 175 and will not moved relative to the first limiting block 175. In some embodiments, as shown in FIG. 19, a second supporting block 44 is disposed between the long rod upper end of the long rod 15 and the adjustment rod 174. Upper and lower end surfaces of the second supporting block 44 are respectively abutted against the long rod 15 and the adjustment rod 174, and are used for limiting the long rod 15 and the adjustment rod 174 from swing transversally due to a non-uniform stress when the long rod 15 and the adjustment rod 174 are moved up and down along the longitudinal direction. It should be understood that the second supporting block 44 has a tight fit with the outer sleeve 11, so that a swing phenomenon will not occur in the movement along the longitudinal direction.

In some embodiments, the long rod 15 may be connected with the adjustment element lower end of the adjustment element 17, so the stability in movement along the longitudinal direction is guaranteed. Similarly, the adjustment element 17 may also be connected with a locating element lower end. In some embodiments, the fixed connection therebetween may also implement the effect to be achieved by this embodiment. In some embodiments, the second supporting block 44 may be connected with the long rod 15 and the adjustment element 17. The above connection manner may also be a manner of which a shaft is inserted into a hole, and the cooperation relationship may also be tight fit. In some embodiments, the adjustment sleeve 171 may also be connected to the wall of the cavity of the outer sleeve 11, wherein the connection may be a tight fit. The structure of the adjustment element 17 in some embodiments may be used in the automatic umbrella frame and the automatic umbrella.

Referring to FIG. 1, FIGS. 20-23, in some embodiments, the adjustment element 18 comprises a second elastic element 181 and a limiting rod 182. The second elastic element comprises a second elastic element upper end abutted against the locating element 12 and a second elastic element lower end abutted against a first supporting block 183. The first supporting block 183 comprises a first supporting block upper end abutted against the second elastic element 181. The limiting rod 182 comprises a limiting rod upper end connected to the locating element 12. The first supporting block lower end of the first supporting block 183 is abutted against the first elastic element 14. The first supporting block 183 is moved along the longitudinal direction under the pressure from the first elastic element 14 or the second elastic element 181. A second limiting block 183A protruded outwards is arranged at the periphery of the first supporting block 183. The outer sleeve 11, along the longitudinal direction, is provided with a third limiting slot 111 penetrated through the inner and outer surfaces of the outer sleeve 11 and limiting movement direction of the second limiting block 183A. When the first supporting block 183 is moved up and down along the longitudinal direction from the pressure of the first elastic element 14 or the second elastic element 181, the second limiting block 183A is moved along the third limiting slot 111, and thus the first supporting block 183 can only move up and down along the longitudinal direction, and it could assure that the first supporting block 183 will not swung in movement to result in the swung and deformation of the first elastic element 14 and the second elastic element 181. When the compression amount of the first elastic element 14 is too large, by transferring a part of this pressure to the second elastic element 181, the pressure stressed on the first elastic element 14 may be reduced, that is, the deformation of the first elastic element 14 can be reduced.

In some embodiments, the locating element 12, the limiting rod 182, the first supporting block 183, and the long rod 15 may be solid, which increases the support force for the line 24 in the embodiments mentioned above. Likewise, the locating element 12, the limiting rod 182, the first supporting block 183, and the long rod 15 may be of a hollow structure. The line 24 can be allowed to pass through the hollow center to be threaded through the pulley component at the lower side of the long rod 15. In some embodiments, the long rod upper end of the long rod 15 can be connected with the first supporting block. The first supporting block 183 is connected with the outer sleeve 11, so as to be adapted to drive the long rod 15 to move upwards together when the outer sleeve 11 is moved upwards.

Figure 22:
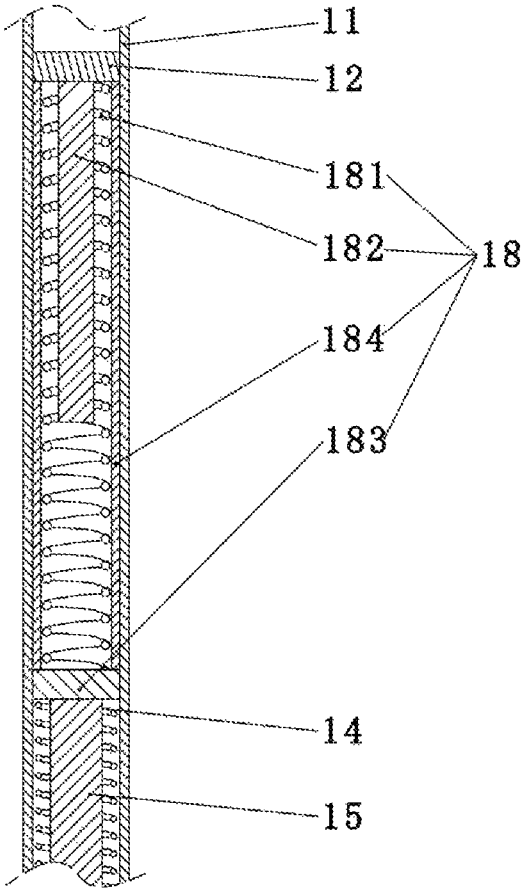
Figure 23:
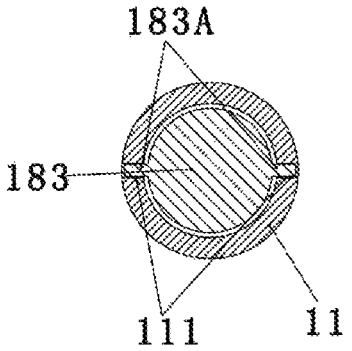
FIG. 23 is a structural schematic diagram of cross-sections of a first supporting block and an outer sleeve in a fifth embodiment of the present disclosure.

In some embodiments, as shown in FIG. 22, there may be other variation for the adjustment element 18 in some embodiments. A second reinforcing sleeve 184 is disposed at the periphery of the second elastic element 181. The second reinforcing sleeve 184 is connected to the wall of the cavity of the outer sleeve 11 and is configured to enhance the strength of the outer sleeve 11. The structure of the adjustment element 18 in some embodiments may be used in the automatic umbrella frame and the automatic umbrella in the embodiments mentioned above.

Figure 24:
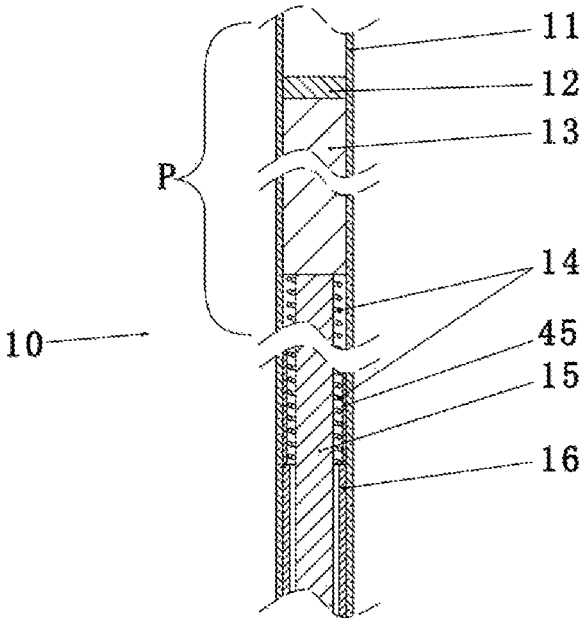
FIG. 24 is a structural schematic diagram of a middle rod in a sixth embodiment of the present disclosure.

Referring to FIG. 24, the present disclosure further provides a first reinforcing sleeve 45. The first reinforcing sleeve 45 is disposed between the periphery of the first elastic element 14 and the wall of the cavity of the outer sleeve 11. When the first elastic element 14 is in a completely compressed state, a first reinforcing sleeve lower end of the first reinforcing sleeve 45 can be abutted against the movable sleeve upper end of the movable sleeve 16. The first reinforcing sleeve 45 is connected with the outer sleeve 11, so as to enhance the strength of the outer sleeve 11. It could be understood that the first reinforcing sleeve 45 will be moved along the longitudinal direction along with the outer sleeve 11 relative to the movable sleeve 16. The movement of the first reinforcing sleeve 45 will not interfere the movement of the movable sleeve 16 or the outer sleeve 11.

Any modification, equivalent replacement, improvement and the like made within the spirit of the present disclosure should be included in the protection scope of the present disclosure.

What is claimed is:

1. A middle rod structure of an automatic umbrella, comprising an outer sleeve, extending along a longitudinal direction;

a movable sleeve, comprising a movable sleeve upper end located inside the outer sleeve; the movable sleeve is movable within the outer sleeve;

a first elastic element, held in the outer sleeve; the first elastic element is capable of applying a pressure along the longitudinal direction to the movable sleeve abutted against a first elastic element lower end of the first elastic element when being compressed;

a locating element, located inside the outer sleeve, securing a first elastic element upper end of the first elastic element;

an adjustment element, arranged between the first elastic element and the locating element; and upper end and a long rod lower end; wherein the long rod upper end is abutted against the adjustment element, and the long rod lower end is located inside the movable sleeve for limiting the first elastic element from moving along a direction perpendicular to the longitudinal direction;

wherein the adjustment element comprises:

an adjustment sleeve, comprising an outer edge extending longitudinally and connected with the outer sleeve;

an adjustment rod, comprising an adjustment rod upper end located inside the adjustment sleeve; and a first limiting slot, extending through inner and outer surfaces of the adjustment sleeve along the longitudinal direction; the first limiting slot is formed on a circumference of the adjustment sleeve; a plurality of second limiting slots communicating with the first limiting slot and extending along an adjustment sleeve periphery are formed at a first limiting slot side edge of the first limiting slot along the longitudinal direction; a first limiting block protruding from an outer circumference of the adjustment rod; and the first limiting block is capable of attaching to and detaching from to the second limiting slots when being rotated relative to the adjustment sleeve.

2. An automatic umbrella frame, comprising a middle rod structure; the middle rod structure comprises:

an outer sleeve, extending along a longitudinal direction;

a movable sleeve, comprising a movable sleeve upper end located inside the outer sleeve; the movable sleeve is movable within the outer sleeve;

a first elastic element, held in the outer sleeve and capable of applying a pressure along the longitudinal direction to the movable sleeve when being compressed;

a locating element, located inside the outer sleeve and securing a first elastic element upper end of the first elastic element;

an adjustment element, arranged between the first elastic element and the locating element; and a long rod, comprising a long rod upper end and a long rod lower end; wherein the long rod upper end is abutted against the adjustment element, and the long rod lower end is located inside the movable sleeve for limiting the first elastic element from moving along a direction perpendicular to the longitudinal direction;

an upper nest, connected with an outer sleeve upper end;

a lower nest, which is movable along a longitudinal direction relative to the outer sleeve;

an umbrella supporting skeleton, connected to the upper nest and the lower nest and performing an umbrella opening or closing operation when the lower nest is moved upwards or downwards along the longitudinal direction;

a first pulley component, comprising a first pulley component lower end and a first pulley component upper end; the first pulley component lower end is abutted against the locating element, and the first pulley component upper end is located inside the upper nest;

a lower pulley assembly, located inside the movable sleeve and abutted against the long rod lower end;

a drive mechanism, located inside a lower portion of the movable sleeve; and a line, wherein a first end of the line is connected to the lower pulley assembly, and a second end of the line is connected to the lower nest, and the line is wound on the first pulley component;

wherein the movable sleeve is detached from a first limiting element which is disposed on the drive mechanism when a button disposed on the drive mechanism is pressed; and the lower pulley assembly is secured to a fourth limiting slot formed on a tighten-up set when the first elastic element is restored to a compressed state and is detached from the fourth limiting slot when being pressed by the button.

3. The automatic umbrella frame as claimed in claim 2, wherein the adjustment element comprises an adjustment sleeve, comprising an outer edge extending longitudinally and connected with the outer sleeve;

an adjustment rod, comprising an adjustment rod upper end located inside the adjustment sleeve; the adjustment rod is movable and rotatable inside the adjustment sleeve and;

a first limiting slot, wherein the first limiting slot is provided from an outer surface to an inner surface of the adjustment sleeve and extends along the longitudinal direction; the first limiting slot is formed on a circumference of the adjustment sleeve;

a plurality of second limiting slots communicating with the first limiting slot and extending along an adjustment sleeve periphery are formed at a first limiting slot side edge of the first limiting slot along the longitudinal direction; and a first limiting block arranged on an outer circumference of the adjustment rod;

wherein the first limiting block is secured to one of the plurality of second limiting slots when being rotated.

4. The automatic umbrella frame as claimed in claim 2, wherein the adjustment element comprises a second elastic element, comprising a second elastic element upper end abutted against the locating element, and a second elastic element lower end abutted against a first supporting block; the first supporting block comprises a first supporting block lower end abutted against the first elastic element; and a limiting rod, comprising a limiting rod upper end connected to the locating element; and wherein the first supporting block is moved along the longitudinal direction under the pressure from the first elastic element.

5. The automatic umbrella frame as claimed in claim 4, wherein a second limiting block protruded outwards is arranged at an first supporting block periphery of the first supporting block; and the outer sleeve is provided with a third limiting slot along the longitudinal direction, wherein the third limiting slot extends through inner and outer surfaces of the outer sleeve and limits the movement of the second limiting block along the longitudinal direction.

6. The automatic umbrella frame as claimed in claim 2, wherein the lower pulley assembly comprises the tighten-up set located in the movable sleeve, a third pulley component, held in the movable sleeve and movable along the longitudinal direction relative to the tighten-up set; the third pulley component is connected with the first end of the line; and a second pulley component disposed on an upper side of the third pulley component and abutted against the long rod lower end; and the second pulley component is threaded through by the line.

7. The automatic umbrella frame as claimed in claim 2, wherein the umbrella supporting skeleton comprises a plurality of first umbrella sub-ribs, comprising a first umbrella sub-rib fixed end hinged to the upper nest;

a plurality of traction elements, wherein each of the plurality of traction elements comprises a through hole and each of the plurality of traction elements is hinged to a first umbrella sub-rib free end of one of the plurality of first umbrella sub-ribs;

a plurality of reverse-folding umbrella ribs, wherein a fixed end of each of the plurality of reverse-folding umbrella ribs is hinged with a first hinge point on one of the plurality first umbrella sub-ribs;

a plurality of second umbrella sub-ribs, comprising a second umbrella sub-rib free end attached to a reverse-folding umbrella rib free end of the reverse-folding umbrella rib via a sliding block, and a second umbrella sub-rib fixed end attached to the lower nest; and a plurality of supporting ribs, comprising a supporting rib fixed end hinged to the lower nest and a supporting rib free end attached to one of the plurality of first umbrella sub-ribs.

8. An automatic umbrella, comprising an automatic umbrella frame, an outer umbrella cloth, and an inner umbrella cloth; wherein the outer umbrella cloth covers and is secured to upper sides of first umbrella sub-ribs and reverse-folding umbrella ribs; and the inner umbrella cloth covers and is secured to lower sides of second umbrella sub-ribs, wherein the outer umbrella cloth in an umbrella opening state completely covers the inner umbrella cloth; wherein the automatic umbrella frame comprises:

a middle rod structure; the middle rod structure comprises:

an outer sleeve, extending along a longitudinal direction;

a movable sleeve, comprising a movable sleeve upper end located inside the outer sleeve; the movable sleeve is movable within the outer sleeve;

a first elastic element, held in the outer sleeve; the first elastic element is capable of applying a pressure along the longitudinal direction to the movable sleeve abutted against a first elastic element lower end of the first elastic element when being compressed;

a locating element, located inside the outer sleeve and securing a first elastic element upper end of the first elastic element;

an adjustment element, arranged between the first elastic element and the locating element; and a long rod, comprising a long rod upper end and a long rod lower end; wherein the long rod upper end is abutted against the adjustment element, and the long rod lower end is located inside the movable sleeve for limiting the first elastic element from moving along a direction perpendicular to the longitudinal direction;

an upper nest, connected with an outer sleeve upper end of an outer sleeve;

a lower nest, which is movable along a longitudinal direction relative to the outer sleeve;

an umbrella supporting skeleton, connected to the upper nest and the lower nest and configured for performing an umbrella opening or closing operation when the lower nest is moved upwards or downwards along the longitudinal direction;

a first pulley component, comprising a first pulley component lower end and a first pulley component upper end; the first pulley component lower end is abutted against the locating element, and the first pulley component upper end is located inside the upper nest;

a lower pulley assembly, located inside the movable sleeve and abutted against the long rod lower end;

a drive mechanism located inside a lower portion of the movable sleeve; and a line, wherein a first end of the line is connected to the lower pulley assembly, and a second end of the line is connected to the lower nest, and the line is wound on the first pulley component;

wherein the movable sleeve is detached from a first limiting element which is disposed on the drive mechanism when a button disposed on the drive mechanism is pressed; and the lower pulley assembly is secured to a fourth limiting slot formed on a tighten-up set when the first elastic element is restored to a compressed state and is detached from the fourth limiting slot when being pressed by the button.

9. The automatic umbrella as claimed in claim 8, wherein the adjustment element comprises:

an adjustment sleeve, comprising an outer edge extending longitudinally and connected with the outer sleeve; and an adjustment rod, comprising an adjustment rod upper end; the adjustment rod upper end is located inside the adjustment sleeve and is movable along the adjustment sleeve and rotatable around the adjustment sleeve;

a first limiting slot, extending through inner and outer surfaces of the adjustment sleeve; the first limiting slot is formed on an adjustment sleeve circumference;

a plurality of second limiting slots communicating with the first limiting slot and extending along an adjustment sleeve periphery; the plurality of second limiting slots are formed at a first limiting slot side edge of the first limiting slot along the longitudinal direction; and a first limiting block arranged on an outer circumference of the adjustment rod;

wherein the first limiting block is secured to one of the plurality of second limiting slots when being rotated.

* * * * *